US011543224B2

(12) United States Patent
Brown et al.

(10) Patent No.: US 11,543,224 B2
(45) Date of Patent: Jan. 3, 2023

(54) EXPLOSIVE DETONATING SYSTEM AND COMPONENTS

(71) Applicant: River Front Services, Inc., Chantilly, VA (US)

(72) Inventors: Anthony Miles Brown, Sneads Ferry, NC (US); Toby Justin Harvey, Nederland, CO (US); Donald Ray Brown, Oakton, VA (US); Thomas Jeffrey Harvey, Nederland, CO (US)

(73) Assignee: River Front Services, Inc., Chantilly, VA (US)

( * ) Notice: Subject to any disclaimer, the term of this patent is extended or adjusted under 35 U.S.C. 154(b) by 32 days.

(21) Appl. No.: 16/878,450

(22) Filed: May 19, 2020

(65) Prior Publication Data

US 2020/0284570 A1 Sep. 10, 2020

Related U.S. Application Data

(63) Continuation-in-part of application No. 16/111,481, filed on Aug. 24, 2018.
(Continued)

(51) Int. Cl.
*F42D 1/04* (2006.01)
*F42B 39/30* (2006.01)
*C06C 5/06* (2006.01)

(52) U.S. Cl.
CPC ..... *F42D 1/043* (2013.01); *C06C 5/06* (2013.01); *F42B 39/30* (2013.01)

(58) Field of Classification Search
CPC ..... C06C 5/06; F42D 1/04; F42D 1/043
See application file for complete search history.

(56) References Cited

U.S. PATENT DOCUMENTS 2,687,866 A 8/1954 Johnson
2,911,910 A 11/1959 Welsh, Jr.
(Continued)

FOREIGN PATENT DOCUMENTS

EP 0015067 A1 9/1980
EP 3538837 A1 9/2019
(Continued)

OTHER PUBLICATIONS

"Ensign-Bickford Aerospace & Defense, Rapid Wall Breaching Kit, web page as of Oct. 3, 2016."
(Continued)

*Primary Examiner* — Joshua T Semick
(74) *Attorney, Agent, or Firm* — Johnson, Marcou, Isaacs & Nix, LLC

(57) ABSTRACT

An explosive detonating system comprises connectable components to connect/disconnect a pathway that ignites an explosion. A firing actuator activates primers. An adapter connects the firing actuator to shock tube and channels the ignition force from the primers into the shock tube. A cap box houses blasting caps coupled to the end of the shock tube. A priming well is coupled to the cap box/blasting caps and detonating cord. When the firing actuator is initiated, the percussion caps ignite, sending an explosive jet of gas into the shock tube, which ignites an explosive liner. An explosive wave travels through the shock tube and activates the blasting caps, which activate the detonating cord in the priming well. The explosive is placed in a location to provide a desired explosive effect. For example, the system may be employed as a system to breach into structures, remove obstacles and/or barriers, or other applications.

21 Claims, 30 Drawing Sheets

Related U.S. Application Data

(60) Provisional application No. 62/850,275, filed on May 20, 2019, provisional application No. 62/549,915, filed on Aug. 24, 2017.

(56) References Cited

U.S. PATENT DOCUMENTS

| | | | | |
|---|---|---|---|---|
| 2,923,239 | A | 2/1960 | Andrew | |
| 3,169,478 | A | 2/1965 | Schaaf | |
| 3,320,883 | A | 5/1967 | Martin | |
| 3,327,979 | A | 6/1967 | Akio | |
| 3,374,737 | A | 3/1968 | Pike | |
| 3,431,574 | A | 3/1969 | Mathieu | |
| 3,782,284 | A | 1/1974 | Gibb | |
| 3,783,787 | A | 1/1974 | Thornley | |
| 4,015,506 | A | 4/1977 | Musgrave | |
| 4,381,711 | A * | 5/1983 | Lawrence | F42C 7/12 102/200 |
| 4,408,535 | A | 10/1983 | Alford | |
| 4,499,828 | A | 2/1985 | Honodel | |
| 4,813,358 | A | 3/1989 | Roberts | |
| 4,856,430 | A | 8/1989 | Gibb | |
| 4,957,027 | A * | 9/1990 | Cherry | F41B 9/0046 89/1.14 |
| 5,012,741 | A * | 5/1991 | Peebles | C06C 5/06 102/275.3 |
| 5,020,435 | A | 6/1991 | Cawte | |
| 5,036,588 | A * | 8/1991 | Cherry | F42B 3/006 83/639.1 |
| 5,171,935 | A | 12/1992 | Michna | |
| 5,417,162 | A * | 5/1995 | Adams | F42D 1/043 102/317 |
| 5,499,581 | A * | 3/1996 | Sutula, Jr. | F42D 1/043 102/275.12 |
| 5,703,320 | A * | 12/1997 | Lucca | F42D 1/043 102/275.12 |
| 5,714,712 | A * | 2/1998 | Ewick | C06C 5/06 102/317 |
| 6,006,671 | A * | 12/1999 | Yunan | F42D 1/04 102/275.9 |
| 6,581,519 | B1 * | 6/2003 | Adams | F42D 1/04 102/275.6 |
| 6,681,701 | B2 * | 1/2004 | Perry | F42D 1/043 102/275.7 |
| 7,490,554 | B2 * | 2/2009 | Lynch | F42C 7/12 102/275.12 |
| 7,665,401 | B2 * | 2/2010 | Ballantine | F42D 1/043 102/331 |
| 7,765,932 | B2 * | 8/2010 | Allman | C06C 5/06 102/275.6 |
| 7,802,509 | B2 | 9/2010 | Wall | |
| 7,819,063 | B1 | 10/2010 | Lehman | |
| 7,926,423 | B2 | 4/2011 | Rickman | |
| 7,934,292 | B2 | 5/2011 | Degner | |
| 8,006,621 | B1 | 8/2011 | Cherry | |
| 8,194,403 | B2 | 6/2012 | Liu | |
| 8,267,013 | B2 | 9/2012 | Moore | |
| 8,402,892 | B1 * | 3/2013 | Scheid | C06C 5/06 102/275.12 |
| 8,826,821 | B2 | 9/2014 | Martin | |
| 8,904,937 | B2 | 12/2014 | Mangolds | |
| 9,709,213 | B2 | 7/2017 | Zheng | |
| 9,791,247 | B2 * | 10/2017 | Parker | C06C 5/06 |
| 9,857,831 | B2 | 1/2018 | Senatori | |
| 9,909,035 | B1 | 3/2018 | Caldeira | |
| 2001/0055540 | A1 | 12/2001 | Bonamarte | |
| 2005/0092877 | A1 | 5/2005 | Carnevali | |
| 2005/0126420 | A1 | 6/2005 | Givens | |
| 2005/0179724 | A1 | 8/2005 | Salt | |
| 2007/0125256 | A1 | 6/2007 | Frickey | |
| 2011/0072956 | A1 | 3/2011 | Wall | |
| 2011/0197779 | A1 | 8/2011 | Moore | |
| 2012/0073155 | A1 | 3/2012 | Mabey | |
| 2012/0074291 | A1 | 3/2012 | Fu | |
| 2012/0106043 | A1 | 5/2012 | Murakata | |
| 2012/0145027 | A1 | 6/2012 | Martin | |
| 2014/0048672 | A1 | 2/2014 | Woodruff | |
| 2015/0008302 | A1 | 1/2015 | Fan | |
| 2015/0092427 | A1 | 4/2015 | Nopper | |
| 2015/0108313 | A1 | 4/2015 | Leung | |
| 2015/0184799 | A1 | 7/2015 | Whitney | |
| 2015/0292672 | A1 | 10/2015 | Dose | |
| 2016/0134733 | A1 | 5/2016 | Murphy | |
| 2016/0202033 | A1 | 7/2016 | Shahinpour | |
| 2016/0226126 | A1 | 8/2016 | Daton-Lovett | |
| 2016/0286016 | A1 | 9/2016 | Lee | |
| 2017/0223862 | A1 | 8/2017 | Justiss | |
| 2018/0128419 | A1 | 5/2018 | Brown | |
| 2019/0063892 | A1 | 2/2019 | Brown | |
| 2019/0103650 | A1 | 4/2019 | Daton-Lovett | |
| 2020/0002242 | A1 | 1/2020 | Brown | |
| 2020/0132247 | A1 | 4/2020 | Brown | |

FOREIGN PATENT DOCUMENTS

| | | | | |
|---|---|---|---|---|
| EP | 3673227 | A2 | 7/2020 | |
| EP | 3940334 | A1 | 1/2022 | |
| FR | 2300325 | A1 | 9/1976 | |
| GB | 1415204 | A | 11/1975 | |
| WO | 9600879 | A1 | 1/1996 | |
| WO | 2008045118 | A2 | 4/2008 | |
| WO | WO 2008/045118 | | 4/2008 | |
| WO | WO-2013175243 | A2 * | 11/2013 | B65H 57/16 |
| WO | 2018089530 | A1 | 5/2018 | |
| WO | 2019199346 | A2 | 10/2019 | |
| WO | 2020055500 | A9 | 4/2020 | |
| WO | 2020236848 | A1 | 11/2020 | |

OTHER PUBLICATIONS

"Extended European Search Report for European Patent Application No. 17869384.2", dated Jul. 13, 2020, 8 pages.

"Final Office Action issued in U.S. Appl. No. 15/807,274, filed Nov. 8, 2017", dated Apr. 11, 2019, 17 pages.

"Gryphon Engineering Services, Gryphon Engineering I Folding Entry Prop Pole (4 Piece), web page as of Oct. 3, 2016."

"International Preliminary Reporton Patentability PCT/US2017/060685", dated May 21, 2018, 12 pages.

"International Search Report and Written Opinion issued in International Patent Application No. PCT/US2017/060685 filed Nov. 8, 2017", dated Jan. 22, 2018, 9 pages.

"International Search Report and Written Opinion issued in International Patent Application No. PCT/US2018/047861 filed Aug. 24, 2018", dated Jan. 24, 2020, 20 pages.

"International Search Report and Written Opinion issued in International Patent Application No. PCT/US2019/039991 filed Jun. 28, 2019", dated Jun. 8, 2020, 16 pages.

"Notification of Transmittal of international Preliminary Report on Patentability (Chapter II of the Patent Cooperation Treaty) and International Preliminary Report on Patentability (Chapter II of the Patent Cooperation Treaty) for PCT/US2017/060685", dated Oct. 19, 2018, 9 pages.

"Notification of Transmittal of International Preliminary Report on Patentability (Chapter II), and Communication in Cases for Which No Other Form is Applicable for PCT/US2017/060685", dated Dec. 3, 2018, 14 pages.

"Office Action issued in U.S. Appl. No. 15/807,274, filed Nov. 8, 2017", dated Aug. 27, 2018, 21 pages.

"Office Action issued in U.S. Appl. No. 16/729,012, filed Dec. 27, 2019", dated Apr. 14, 2020, 15 pages.

Lou, et al., "A Combined Analytical and Experimental Study on Space Inflatable Booms", Aerospace Conference Proceedings, 2000, IEEE, Mar. 18-25, 2000 vol. 2, Mar. 18, 2000, 503-511.

Madeira, "Invitation to Pay Additional Fees issued in International Patent Application No. PCT/US2018/047861 filed Aug. 14, 2018", dated Nov. 21, 2019, 15 pages.

U.S. Appl. No. 16/111,481 to Brown et al., filed Aug. 24, 2018.

U.S. Appl. No. 16/729,012 to Brown et al., filed Dec. 27, 2019.

(56) References Cited

OTHER PUBLICATIONS

U.S. Appl. No. 16/457,742 to Brown et al., filed Jun. 28, 2019.
"Communication under Rule 71(3) EPC, Intention to Grant, in Application No. EP 18908272.0 dated Mar. 16, 2021".
"Decision to grant a European patent pursuant to Article 97(1) EPC in Application No. EP 18908272.0 dated May 28, 2021", 2 pages.
"International Search Report & Written Opinion issued in PCT International Application No. PCT/US2020/033660 filed May 19, 2020", dated Sep. 15, 2020, 13 pages.
"Office Action issued in U.S. Appl. No. 16/457,742, filed Jun. 28, 2019" dated Sep. 28, 2020.
"Ideal Blasting Supply; Detonating Cord Connectors 50/25 Grain (Bag of 50), web page as of Jan. 18, 2021", https://idealblasting.com/det-cord-connectors-50-25-grain-bag-of-50/, 3 pages.
"Inert Products, LLC; Raptor Combo Connector (Det Cord Connector) web page as of Jan. 18, 2021", https://inertproducts.com/product/raptor-combo-connector/, 2 pages.
"Office Action cited in U.S. Appl. No. 16/111,481, filed Aug. 24, 2018", dated Feb. 2, 2021, 10 pages.
"Optactical.com; ITW Nexus Quick Cap Connector—CDDI—Dual Detonation Instantaneous; web page as of Jan. 18, 2021", https://www.optactical.com/itwnequcapco3.html.
"International Preliminary Report on Patentability issued in PCT International Application No. PCT/US2020/033660 filed May 19, 2020", dated Dec. 2, 2021, 10 pages.
"Notice of Allowance issued in U.S. Appl. No. 16/111,481, filed Aug. 24, 2018", dated Jul. 12, 2022, 43 pages.
"Extended European Search Report", issued by the European Patent Office for EP Application No. 21180779.7, 8 pages.

* cited by examiner

EXPLOSIVE DETONATING SYSTEM AND COMPONENTS

CROSS REFERENCE TO RELATED APPLICATIONS

This application claims priority to U.S. Provisional Patent Application No. 62/850,275 filed May 20, 2019 and titled "Shock Tube Adapter and Blasting Cap Box." This application also claims priority to and is a continuation-in-part of U.S. patent application Ser. No. 16/111,481 filed Aug. 24, 2018 and titled "Explosive Detonating System and Components," which claims priority to U.S. Provisional Patent Application No. 62/549,915 filed Aug. 24, 2017 and titled "Breaching System." The entire contents of the above-identified priority applications are hereby fully incorporated herein by reference.

TECHNICAL FIELD

The invention described herein relates to an explosive detonating system and, more particularly, to an explosive detonating system having one or more connectable components to connect/disconnect the pathway that initiates an explosion.

BACKGROUND

Explosives are used in many modern-day applications. For example, explosives are used in building or other demolition, earth movement for construction, and military applications. Military and law enforcement applications include breaching doors, walls, bulkheads, and other structures. For example, the goal may be to gain rapid entry to a fortified compound or to remove an obstacle for a tactical advantage. In operation, explosives are placed in position and then detonated from a safe distance.

In a conventional explosive initiation sequence, an ignition device, such as a pen flare gun, is utilized to ignite a main explosive charge. The ignition device fires percussion caps, for example, shot gun primers, to initiate the explosive process. The shotgun primers transmit an initiating signal along a stand-off device, such as electrical wire, "shock-tube," or time fuse, to a blasting cap. When activated by the initiating signal, the blasting cap detonates the main explosive charge.

The shock tube allows a user to distance himself from the main explosive charge and also to lower the amount of explosive needed to detonate a charge. The shock tube may be a shock tube, such as NONEL®. Shock tube is a hollow extruded tube containing a thin layer of energetic materials on its inner diameter. Once initiated, the shock tube transmits a signal to a detonating output charge, typically incorporating an instantaneous output or a pre-determined delay. Such a shock tube is "non-electric," so an electric current is not transmitted to the detonator.

In conventional systems, detonators, such as blasting caps, are crimped onto one end of the shock tube. When the firing impulse is delivered from the primers, via hot explosive gas, the shock tube ignites the blasting caps. The blasting caps are taped or affixed to a loop of detonating cord or directly to the explosive charge. Detonating cord typically is a flexible plastic tube filled with an explosive material, such as PETN or similar explosive material. The blasting caps ignite the explosive material in the detonating cord, which explodes along the length of the cord to ignite the main explosive charge.

In conventional systems, a user is in proximity to the explosives throughout the configuration, transportation, and deployment process. The systems are typically configured at a central location and transported assembled to a desired location. If the pen flare gun accidentally fires a primer, such as during transport, the entire explosive sequence starts, resulting in an explosion that may injure the operator(s) and/or compromise the mission. Additionally, in conventional systems, when an operator desires to perform multiple detonations, the operator must transport multiple pen flare guns attached to multiple, independent explosive systems.

Additionally, many different types of conventional shock tube are available. Each shock tube type requires a specialized ignition device configured to connect to the particular shock tube type. These specialized ignition devices are single use, which requires a separate ignition device for each explosive charge. For example, if 10 explosive charges are created, then 10 ignition devices are required to complete the conventional systems.

SUMMARY

This description relates to an explosive detonating system having one or more connectable components to connect/disconnect the pathway that ignites an explosion. The components comprise a firing actuator that activates primers (percussion caps), an adapter that connects the firing actuator to shock tube and channels the ignition force into the shock tube, a cap box that houses blasting caps coupled to the end of the shock tube, and a priming well that is coupled to the blasting caps and the detonating cord. When the firing actuator is initiated, the percussion caps ignite sending extremely hot gas into the adapter, which channels the gas into the shock tube and ignites the low order explosive in the shock tube lining. The low order explosives ignites and creates an explosive wave that travels through the shock tube and activates the blasting caps housed in the cap box and inserted into the priming well, which activate the detonating cord in the priming well. Then, the detonating cord activates a main explosive charge. The main explosive charge is placed in a location to provide a desired effect from the resulting explosion. For example, the system may be employed as a breaching system to breach structures or other suitable applications.

These and other aspects, objects, features, and advantages of the invention will become apparent to those having ordinary skill in the art upon consideration of the following detailed description of illustrated examples.

DETAILED DESCRIPTION

Figure 1:
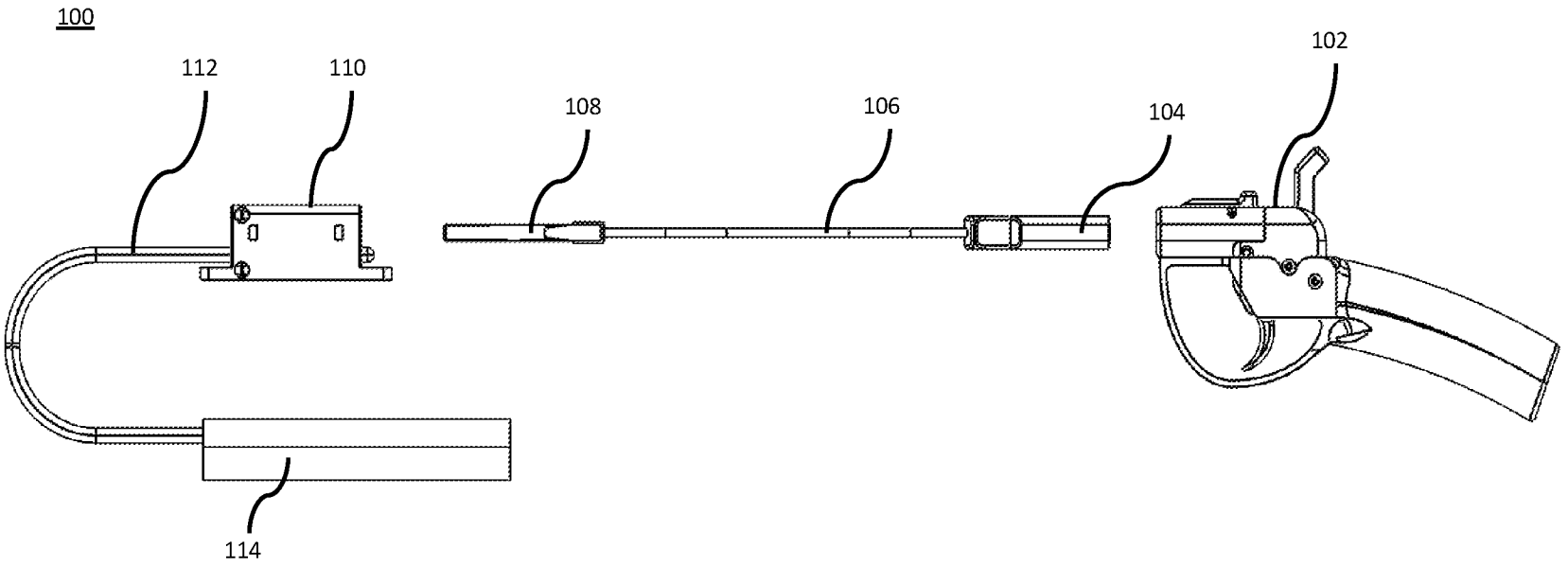
FIG. 1 is an assembly drawing depicting components of the explosive detonating system in exploded form, in accordance with certain examples.

Turning now to the drawings, in which like numerals represent like (but not necessarily identical) elements throughout the figures, the innovations are described in detail. This description relates to an explosive detonating system having one or more connectable components to connect/disconnect the pathway that ignites an explosion. The components comprise a firing actuator that activates primers (percussion caps); an adapter that connects the firing actuator to shock tube and channels the ignition force into the shock tube; a cap box that houses the blasting caps coupled to the end of the shock tube; and a priming well that is coupled to detonating cord or an explosive charge or material. When the firing actuator is initiated, the percussion caps ignite sending hot gases into the adapter, which channels the gas into the shock tube and ignites the low order explosive in the shock tube creating an explosive wave through the shock tube. The explosive wave travels through the shock tube and activates the blasting caps housed in the cap box and inserted into the priming well, which activate the detonating cord in the priming well. Then, the detonating cord activates a main explosive charge. The main explosive charge is placed in a location to provide a desired effect from the resulting explosion. For example, the system may be employed as a breaching system to breach into structures, remove barriers/obstacles, or other suitable applications.

The explosive detonating system includes a quick connect/disconnect between the primer firing actuator and the shock tube. This part of the explosive detonating system comprises the firing actuator, primers, and an adapter cartridge that connects one end of the shock tube to the firing actuator.

The explosive detonating system also includes a quick connect/disconnect between the blasting caps coupled to the other end of the shock tube and the detonating cord that is attached to the main explosive charge. This part of the explosive detonating system includes a cap box and a priming well.

The explosive detonating system can allow an operator to easily and quickly connect/disconnect the components. In this manner, the operator can transport or store a disassembled explosive system that is not in a position to fire accidentally. Then, the operator can connect the system components together when desired with minimal delay. For example, the operator can connect the components of the system when at a location to be breached, thereby not transporting an armed system that could fire accidentally.

The explosive detonating system also can reduce a possibility of the explosive system initiating prematurely compared to conventional systems, which lessens the danger to the operator and bystanders. This benefit is created because the explosive detonating system is disconnected between the primer firing actuator and the shock tube, as well as between the blasting caps and the detonating cord until the operator is ready to initiate the main explosive charge.

Additionally, a single firing actuator for firing the blasting caps can be used for multiple explosive detonating systems. The reusable firing actuator described herein lessons the burden of transporting multiple firing actuators, or other shock tube initiators, to the breaching location.

Figure 2:
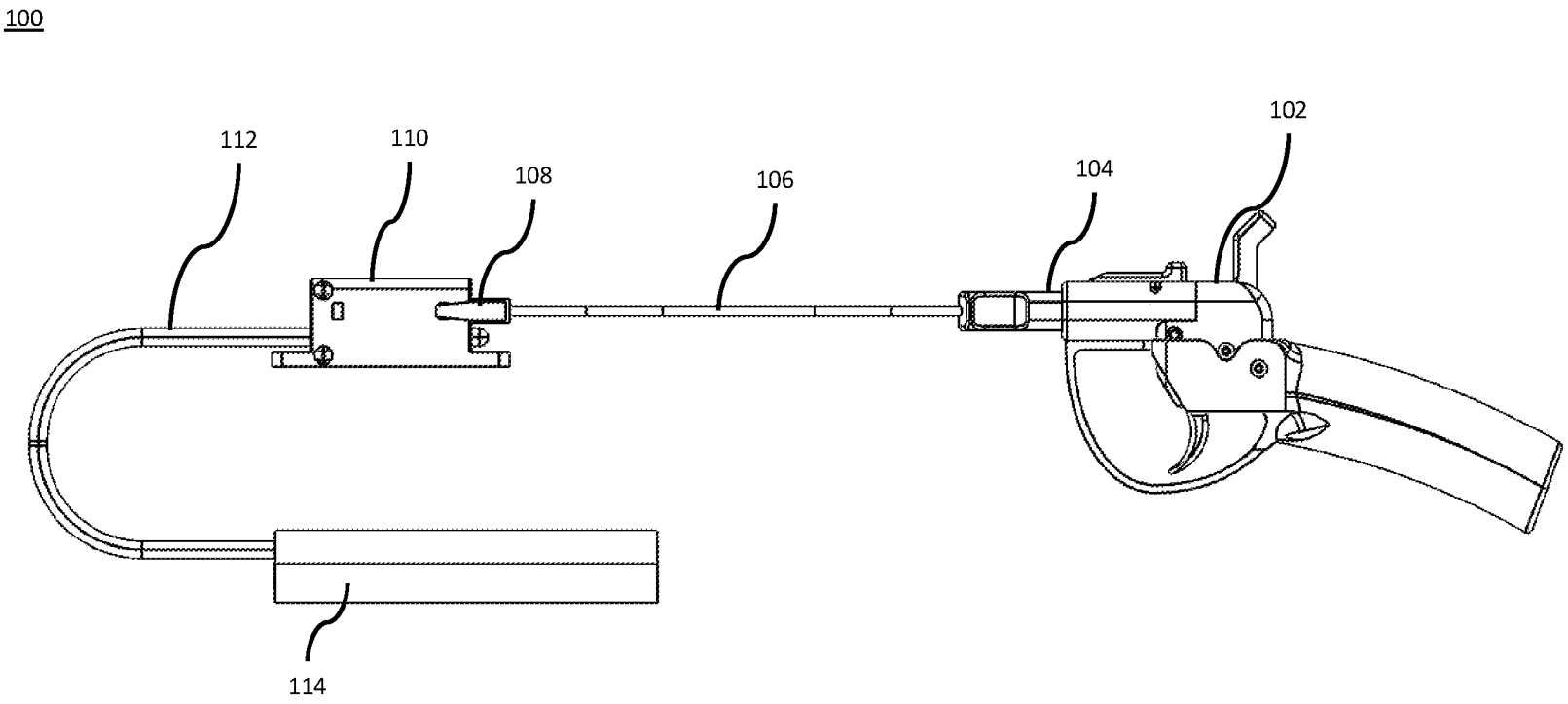
FIG. 2 is an illustration depicting the assembled explosive detonating system, in accordance with certain examples.

FIGS. 1 and 2 are illustrations depicting an explosive detonating system 100, in accordance with certain examples. FIG. 1 is an assembly drawing depicting components of the explosive detonating system 100 in exploded form, in accordance with certain examples. FIG. 2 is an illustration depicting the assembled explosive detonating system 100, in accordance with certain examples.

Figure 4:
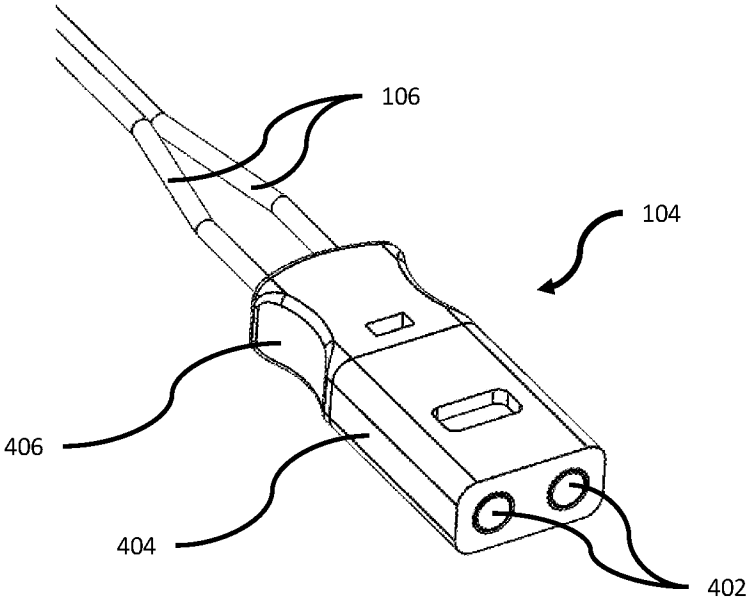
FIG. 4 is a perspective view depicting a shock tube adapter, in accordance with certain examples.

The explosive detonating system 100 comprises a firing actuator 102 that activates one or more primers (not visible in FIGS. 1 and 2; see item 402 of FIG. 4).

A shock tube adapter 104 connects the firing actuator 102 to one end of shock tube 106. The shock tube 106 is inserted into one end of the shock tube adapter 104. The shock tube 106 typically comprises two tubes for redundancy. One or both of the tubes can be uses as desired. The other end of the shock tube adapter 104 is insertable into and removable from the firing actuator 102 and mechanically locks to the firing actuator 102. The shock tube adapter 104 provides a connect/disconnect between the primers and the shock tube 106 and the primers/shock tube 106 and the firing actuator 102. Although not depicted in FIG. 1, the shock tube adapter can comprise a removeable cap that covers and protects the primers from being struck during transport. The cap can be formed from a plastic, rubber, or other suitable material.

Blasting caps (not visible in FIGS. 1 and 2; see item 802 of FIG. 8) are connected to the other end of the shock tube 106. For example, the blasting caps can be crimped or otherwise mechanically fastened to the shock tube 106.

As depicted in FIGS. 1 and 2, the blasting caps can be inserted into a cap box 108. The cap box 108 protects the blasting caps during storage and/or transport of the blasting caps. Additionally, the cap box 108 facilitates coupling the blasting caps to detonating cord 112 via a priming well 110. Although not depicted in FIG. 1, the cap box can comprise a removeable cap or other cover that covers and protects the blasting caps from being struck during transport. The cap can be formed from a plastic, rubber, or other suitable material.

The priming well 110 retains the blasting caps on the shock tube 106 in proximity to the detonating cord 112. The blasting caps and one end of the detonating cord are inserted into the priming well 110. The priming well 110 is designed such that insertion of the blasting caps and the detonating cord 112 into the priming well 110 fixes the blasting caps and the detonating cord 112 in close proximity. For example, the blasting caps and the detonating cord 112 can be inserted into the priming well 110 such that the blasting caps are close enough to the detonating cord 112 to initiate the detonating cord 112 when the blasting caps are initiated. The priming well 110 can retain the blasting caps in contact with the detonating cord 112 prior to initiation of the blasting caps. In this configuration, initiation of the detonating cord 112 by the blasting caps is more reliable. However, the priming well 110 also may retain the blasting caps in proximity to the detonating cord 112 without physical contact between the blasting caps and the detonating cord 112. In this configuration, the gap between the blasting caps and the detonating cord 112 is maintained at a distance that is not more than a distance that will allow the blasting caps to initiate the detonating cord 112.

The other end of the detonating cord 112 is coupled to a main explosive charge 114. The main explosive charge 114 may not be utilized if the explosive force of the detonating cord 112 is sufficient to achieve the desired result.

The priming well 110 provides a connect/disconnect between the blasting caps coupled to the shock tube 106 and the detonating cord 112 that is attached to the main explosive charge 114.

In operation, initiation of the primers by the firing actuator 102 introduces an explosive ignition wave from the primers into the shock tube 106, via the shock tube adapter 104. The explosive wave traveling through the shock tube 106 initiates the blasting caps, which are held in proximity to the detonating cord 112 via the priming well 110. Initiation of the blasting caps initiates the detonating cord 112. Then, the detonating cord 112 initiates the main explosive charge 114.

Figure 3:
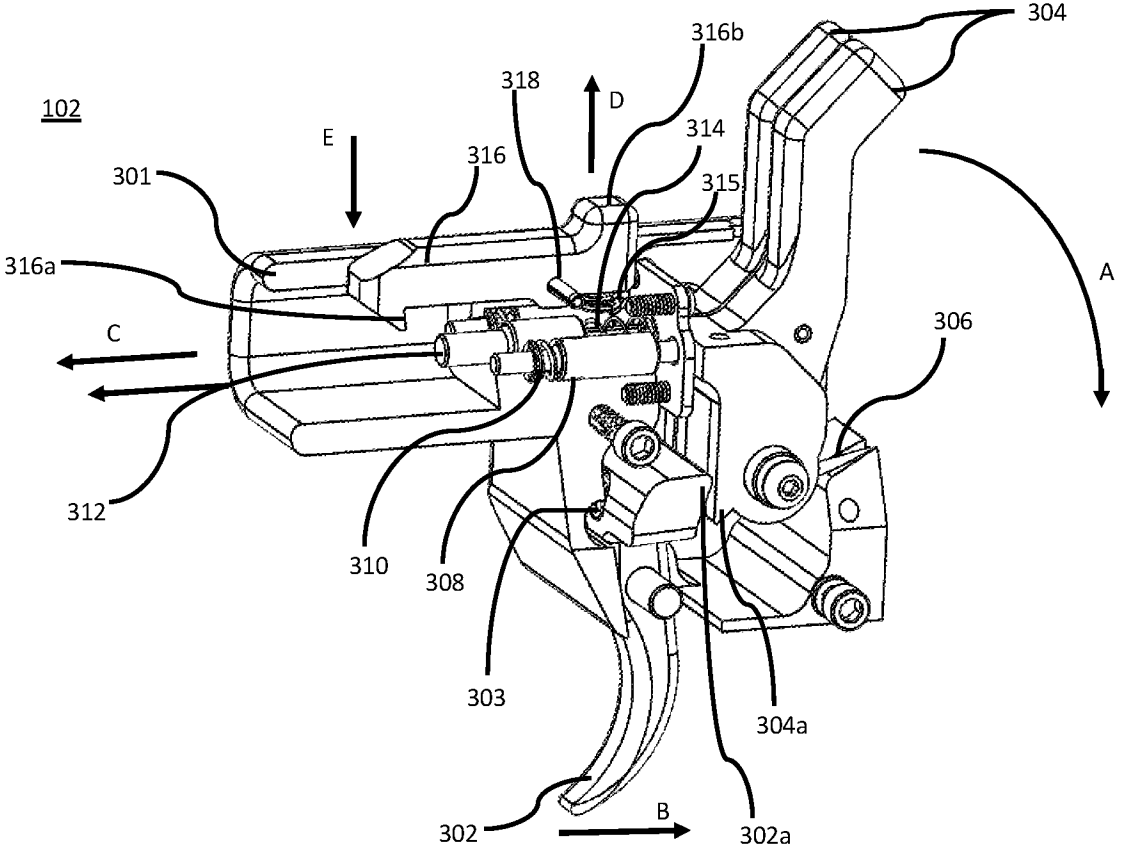
FIG. 3 is a perspective, cut-out view depicting a firing actuator or device or shock tube initiator, in accordance with certain examples.

The firing actuator 102 will now be described with reference to FIG. 3. FIG. 3 is a perspective, cut-out view depicting a firing actuator 102, in accordance with certain examples.

The firing actuator 102 comprises a housing 301 in which multiple components are positioned. A trigger 302 that works in conjunction with one or more hammers 304 mechanically moves one or more corresponding firing pins 308. A trigger reset spring 303 biases an upper portion of the trigger 302 toward the hammers 304.

As shown in FIG. 3, the hammers 304 are depicted in a "safe" position. As the hammers 304 are cocked by movement in direction A, a lower portion of the hammers 304 pushes an upper portion of the trigger 302 against the trigger 302 reset spring until the hammers 304 lock in the cocked position via engagement of the components 302*a* of the trigger 302 and 304*a* of the hammers 304. A hammer torsion spring 306 biases the hammers 304 in a direction opposite of the direction A. The trigger 302 and hammers 304 are held in the cocked position by the biasing force of the trigger reset spring 303 and the hammer torsion spring 306 that engage the components 302*a* of the trigger 302 and 304*a* of the hammers 304.

When the operator pulls the trigger 302 in the direction B, the upper portion of the trigger 302 moves away from the lower portion of the hammers 304 thereby disengaging the components 302*a* of the trigger 302 and 304*a* of the hammers 304. The biasing force of the hammer torsion spring 306 moves the hammers 304 in a direction opposite the direction A with sufficient force to move one or more corresponding firing pins 308 in a direction C. Corresponding firing pin reset springs 310 bias the firing pins 308 in a direction opposite the direction C. As the hammers 304 move in the direction opposite of direction A, the hammers 304 strike the corresponding firing pins 308 with a force sufficient to overcome the biasing force of the firing pin reset springs 310 to cause the firing pins 308 to contact one or more primers (not depicted in FIG. 3) positioned adjacent to the firing pins 308. Another version of the firing actuator 102 comprises a double-action trigger system. In this case, the hammers 304 do not have to be cocked. Pulling the trigger 302 will initially move the hammers 304 in the direction A. Further pulling of the trigger 302 will then release the hammers 304 to move in the direction opposite the direction A to actuate the primers. Additionally, multiple triggers 302 may be provided such that each hammer 304 has a corresponding trigger 302 that actuates that hammer 304.

Although not depicted in FIG. 3, a hammer and firing pin may be combined into a single component. For example, the hammer may have a firing pin formed as part of the hammer. In operation of this design, when the hammer is released from the cocked position, the firing pin on the hammer directly strikes the primer. This operation contrasts to the hammer striking the firing pin, and then the firing pin striking the primer. The firing pin reset springs 310 may be omitted in this design. A single hammer may have two integrally formed firing pins. Two hammers having corresponding integrally formed firing pins may also be utilized.

An ejection latch 316 and ejection pin 312 allow insertion and removal of the shock tube adapter 104 into the firing actuator 102. The ejection latch 316 pivots around a pin 318 coupled to the housing 301. An ejection latch spring 315 biases one end of the ejection latch 316 around the pin 318 in a direction D, which biases an opposite end of the ejection latch 316 in a direction E. As the shock tube adapter 104 is inserted into the firing actuator 102, the shock tube adaptor 106 contacts a tab 316*a* on the ejection latch 316. This contact moves the tab 316*a* of the ejection latch 316 in a direction opposite to direction E, which moves the opposite end 316*b* of the ejection latch 316 around the pin 318 in a direction opposite of the direction D and against the biasing force of the ejection latch spring 315. When the shock tube adapter 104 is inserted fully into the firing actuator 102, the biasing force of the ejection latch spring 315 moves the corresponding end 316*b* of the ejection latch 316 in the direction D, which moves the tab 316*a* in the direction E to engage with a retaining indent (not illustrated in FIG. 3; see item 504*c* of FIG. 5) of the shock tube adapter 104. This engagement locks the shock tube adapter 104 in position in the firing actuator 102. Additionally, when the shock tube adapter 104 is inserted into the firing actuator 102, the shock tube adaptor 104 moves the ejection pin in a direction opposite the direction C against a biasing force of an ejection spring 314.

Although not depicted in FIG. 3, the ejection pin and ejection spring may be replaced with an ejection spring that pushes directly on the shock tube adapter 104. This ejection spring may be fixed in place such that insertion of the shock tube adapter 104 compresses the ejection spring, and the biasing force of the ejection spring pushes the shock tube adapter 104 from the firing actuator 102 when the ejection latch 316 is released.

To remove the shock tube adapter 104 from the firing actuator 102, the operator pushes an end 316*b* of the ejection latch 316 in a direction opposite the direction D against the biasing force of the ejection latch spring 315. This operation moves the tab 316*a* of the ejection latch 316 in a direction opposite to the direction E to disengage the tab 316*a* of the ejection latch 316 from the retaining indent of the shock tube 106 adaptor. The biasing force of the ejection spring 314 moves the ejection pin 312 in the direction C to push the shock tube adaptor 104 from the firing actuator 102.

Various options for implementing the firing actuator 102 are suitable. For example, the firing actuator 102 may comprise a single hammer or multiple hammers 304 and a corresponding single firing pin or multiple firing pins 308. Additionally, a single hammer may be sized to contact both firing pins. If two hammers are utilized, they may be linked together to operate as a single hammer. For example, a pin may be inserted through apertures or slots in both hammers to link the two hammers together. In this case, movement of one hammer results in corresponding movement of the other hammer. The pin can be slideable from one hammer into the other hammer, such that operation of one hammer independently of the other hammer is possible if desired and operation of both hammers as a single unit is possible if desired. Other mechanisms for releasing the hammers 304 from the cocked position may be utilized. If the ejection spring 314 and ejection pin 312 are not used, the operator may manually pull the shock tube adapter 104 from the firing actuator 102. Other latching arrangements may be utilized to retain the shock tube adapter 104 in the firing actuator 102. For example, the ejection latch 316 and ejection latch spring 315 may be positioned on the shock tube adapter 104 to engage with a corresponding retaining indent on the firing actuator 102. The ejection latch 316 may be integral to the firing actuator 102 or the shock tube adapter 104. In this case, the ejection latch spring 315 may be omitted because the elastic force of the ejection latch 316 will bias the ejection latch 316 in position. One or multiple ejection latches may be used.

The firing device comprises two independent firing sides operated at least by one trigger 302. The operator can cock both hammers 304 or one hammer, and the single trigger 302 will release one hammer 304 or both hammers 304 simultaneously, depending on the number of cocked hammers. This operation allows the operator to use one initiating device for either single or dual primed charges.

Figure 5:
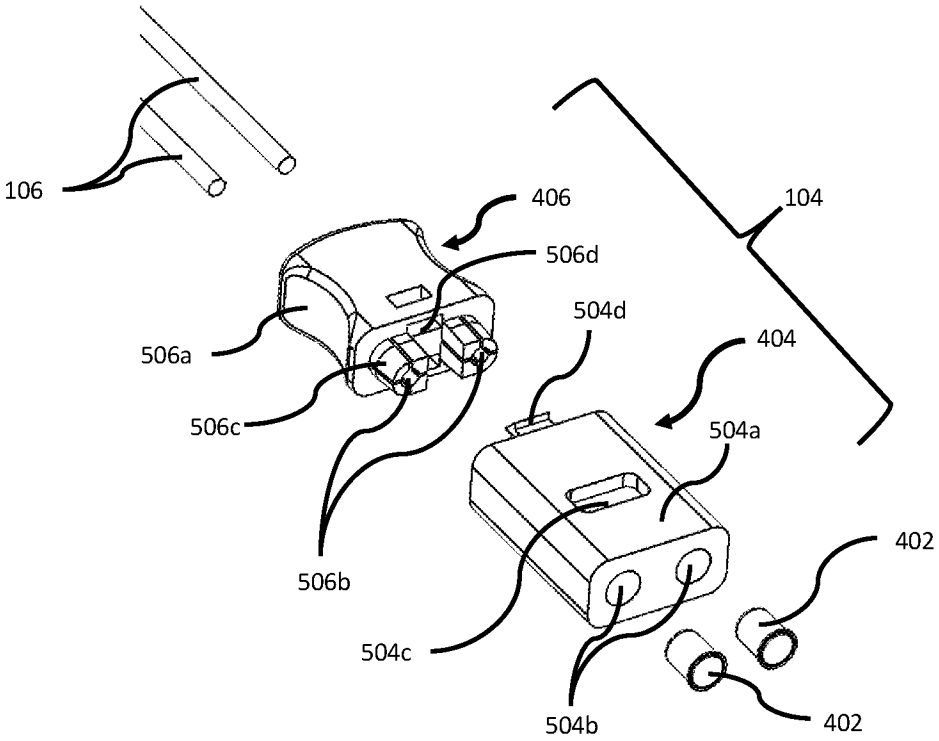
FIG. 5 is a perspective view showing assembly of a two-piece shock tube adapter and shock tube, in accordance with certain examples.

The shock tube adapter 104 will now be described with reference to FIGS. 4 and 5. FIG. 4 is a perspective view depicting a shock tube adapter 104, in accordance with certain examples. FIG. 5 is a perspective view showing assembly of a two-piece shock tube adapter 104 and shock tube 106, in accordance with certain examples.

As shown in FIGS. 4 and 5, the shock tube adapter 104 comprises a primer case 404 and a shock tube case 406. The shock tube 106 is inserted into and retained by the shock tube case 406. Primers are inserted into the primer case 404. The shock tube case 406 and the primer case 404 couple together to form the shock tube adapter 104.

With reference to FIG. 5, the primer case 404 comprises a primer housing 504*a* having continuous apertures 504*b* extending through the primer housing 504*a*. The apertures 504*b* are sized to receive the primers 402. The apertures 504*b* may retain the primers 402 therein via compression fit. The primers 402 also may be adhered into the apertures 504*b*, mechanically retained therein, or otherwise fixed in position. For example, a retainer clip may be utilized to retain the primers 402 in the apertures 504*b*. The primer apertures 504*b* open into an expansion chamber (not visible in FIG. 5; see item 702 of FIG. 7) leading to both shock tubes, thereby allowing either primer charge to initiate one or both shock tubes.

The primer case 404 further comprises a retaining indent 504*c*. The retaining indent 504*c* receives the tab 316*a* of the ejection latch 316 of the firing actuator 102 (as described previously with reference to FIG. 3) when the shock tube adapter 104 is inserted into the firing actuator 102 (as described previously with reference to FIG. 3).

The primer case 404 further comprises at least one retaining tab 504*d*. The tab 504*d* engages a corresponding retaining indent 506*d* in the shock tube case 406 to latch the primer case 404 and the shock tube case 406 together. While only one tab 504*d* is visible, the primer case 404 may include multiple tabs 504*d*. For example, the primer case 404 may include two tabs 504*d* on the top and bottom of an end that faces the shock tube case 406. Alternatively, the tabs may be located on the shock tube case 406 and engage with corresponding indents or apertures on the primer case 404.

The shock tube case 406 comprises a shock tube housing 506*a* having continuous apertures 506*b* extending through the shock tube housing 506*a*. The apertures 506*b* are sized to receive the shock tube 106.

The shock tube case 406 further comprises tabs 506*c* around the apertures 506*b*. The shock tube 106 is inserted into the apertures 506*b* at one end of the shock tube case 406, pushed through the apertures 506*b* of the shock tube case 406, and at least partially engage in the tabs 506*c* on an opposite end of the apertures 506*b* in the shock tube case 406. The shock tube 106 may extend past the tabs 506*c* of the shock tube case 406.

The tabs 506*c* are sized around the apertures 506*b* to allow the shock tube 106 to pass therethrough. The tabs 506*c* are further sized to mate in the aperture 504*b* of the primer case 404 when the shock tube case 406 and the primer case 404 are attached together. As the tabs 506*c* are inserted into the apertures 504*b* of the primer case 404, the apertures 504*b* compress the tabs 506*c* of the shock tube case 406 toward the center of the apertures 506*b* of the shock tube case 406. This movement clamps the tabs 506*c* of the shock tube case 406 around the shock tube 106 in the apertures 506*b* to retain the shock tube 106 in the shock tube case 406. The apertures 506*b* may retain the shock tube 106 therein via compression fit without extending into the tabs 506*c*.

Connecting the shock tube case 406 and the primer case 404 connects the apertures 506*b* of the shock tube case 406 with the apertures 504*b* of the primer case 404 to thereby create a continuous path from the primers 402 through the apertures 504*b* (and sometimes at least part of the apertures 506*b*) to the shock tube 106. In this manner, an explosive wave created by initiation of the primers 402 can travel to the shock tube 106. In one design, the primer case 404 comprises an expansion chamber 702 (see FIG. 7) that connects the apertures 504*b* of the primer case 404 with the apertures 506*b* of the shock tube case 406. Both apertures 504*b* open into the expansion chamber 702, and both apertures 506*b* open into the expansion chamber 702. Accordingly, the expansion chamber 702 funnels the blast from a single percussion cap 402 to both apertures 506*b* to initiate both lines of shock tube 106. Thus, if only one primer fires, the expansion chamber 702 funnels the blast to both lines of shock tube to ensure a dual system ignition. The expansion chamber is optional, and each aperture 504*b* may directly connect to a respective one of the apertures 506*b*. In this case, each primer 402 will activate only a corresponding one of the shock tubes 106.

The shock tube case 406 further comprises one or more retaining indents 506*d* that correspond with the retaining tabs 504*d* of the primer case 404. The retaining indents 506*d* receive the retaining tabs 504*d* to connect the shock tube case 406 to the primer case 404. The operator can push the retaining tabs 504*d* from engagement with the retaining indents 506*d* to disconnect the shock tube case 406 from the primer case 404.

Various options for implementing the shock tube adapter 104 are suitable. For example, the primer case 404 and shock tube case 406 may be formed integrally as a single piece. In this case, the apertures can be continuous from the end in which the primers 402 are inserted to the opposite end in which the shock tube 106 is inserted. This design also can incorporate the expansion chamber 702 between the primer end and the shock tube end of the primer case 404. The apertures for receiving the shock tube 106 can be tapered from the end in which the shock tube 106 is inserted to a smaller area inside the shock tube case 406 or the shock tube adapter 104. In this case, the shock tube adapter 104 retains the shock tube 106 via compression as the shock tube 106 is inserted into the shock tube adapter 104.

The two-piece design of the shock tube adapter 104 allows a further separation of the primers 402 from the blasting caps, detonating cord 112, and the main explosive charge 114. The primer case 404 can be removed from the shock tube adapter 104 to disconnect the primers 402 from the system. The primer also can be carried separately and connected to the shock tube case 406 on location. In another instance, the shock tube adapter can also be a single assembly device in which percussion caps are inserted or press fitted into the firing device end and shock tube is inserted into the explosive end and secured with either a tightening nut, a screw, or other suitable constricting device. The internal paths from the percussion caps to the shock tube can either be straight bore path from one percussion cap to one shock tube opening, or a cross-bored path that intersects or an expansion chamber to allow the explosion from one percussion cap to travel to both shock tube openings. In another instance, the shock tube adapter can be two pieces dissected horizontally creating two identical halves that snap or glue or screw together into a single piece. In this version, the shock tube adapter can have straight bore connects from the percussion caps to the shock tube, or a crossed-bored path or expansion chamber as previously described.

Figure 6:
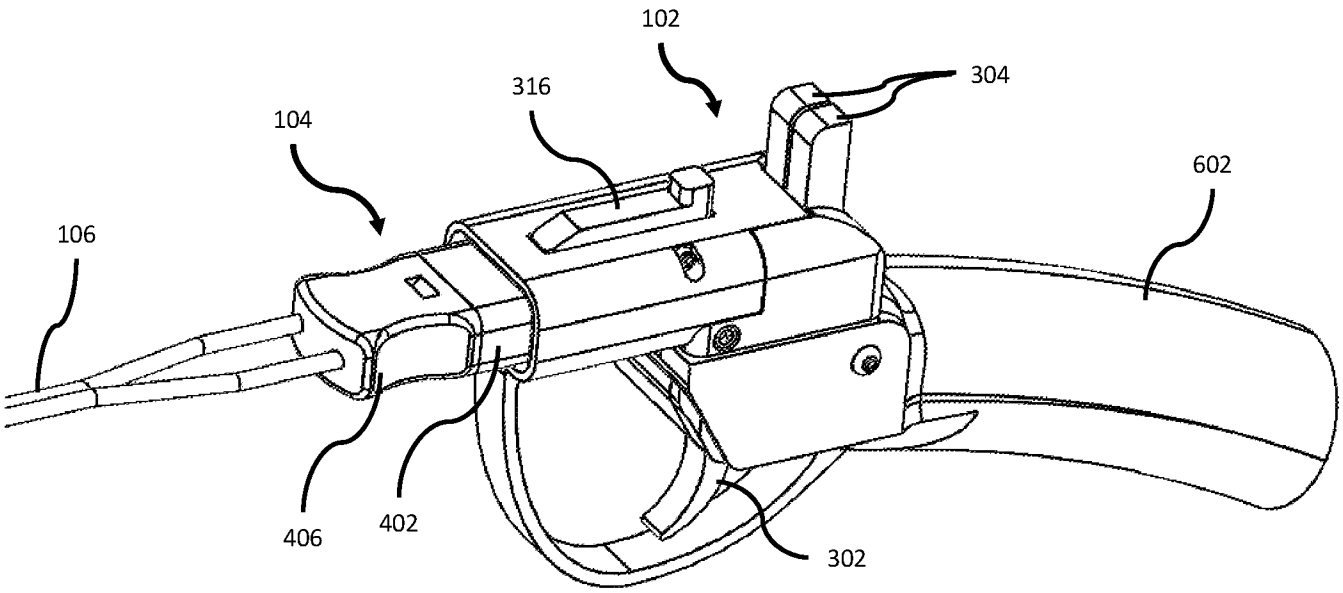
FIG. 6 is a perspective view depicting the shock tube adapter connected to the firing actuator, in accordance with certain examples.
Figure 7:
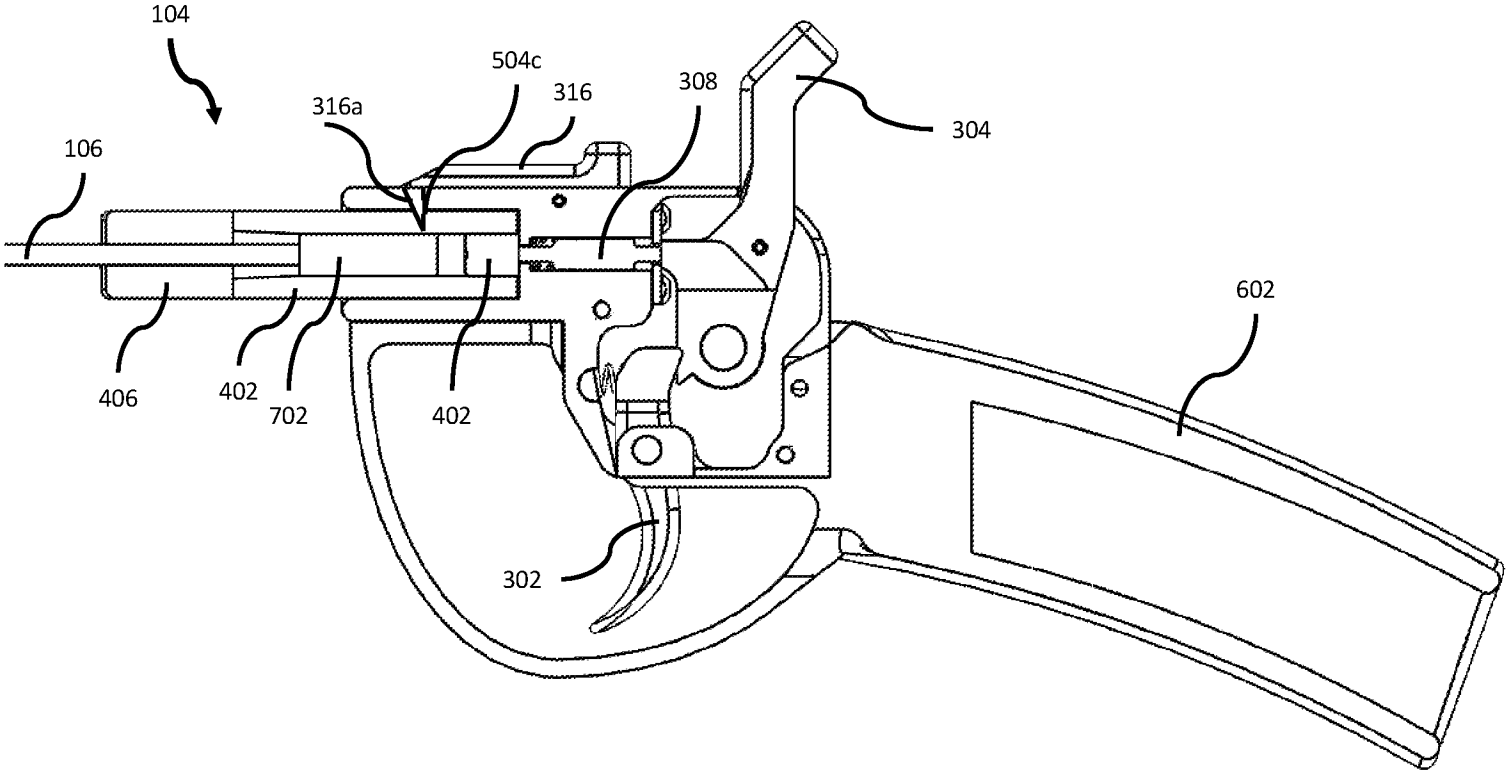
FIG. 7 is a cross-sectional view depicting the shock tube adapter connected to the firing actuator, in accordance with certain examples.

FIGS. 6 and 7 depict the shock tube adapter 104 engaged with the firing actuator 102. FIG. 6 is a perspective view depicting the shock tube adapter 104 connected to the firing actuator 102, in accordance with certain examples. FIG. 7 is a cross-sectional view depicting the shock tube adapter 104 connected to the firing actuator 102, in accordance with certain examples.

The shock tube adapter 104 is inserted into the firing actuator 102 housing until the tab 316*a* of the ejection latch 316 of the firing actuator 102 engages the retaining indent 504*c* of the primer case 404 of the shock tube adapter 104.

Additionally, as shown in FIGS. 6 and 7, a stock 602 can be coupled to the firing actuator 102. The stock 602 may allow easier operation of the firing actuator 102 by the operator.

If only one primer 402 is loaded into the shock tube 106 adaptor, the firing actuator 102 will fire the single primer 402. If two primers 402 are loaded into the shock tube 106 adaptor, the firing actuator 102 will fire both primers 402.

The system can utilize two primers 402, two firing pins 308, two shock tubes 106, and two blasting caps to create redundancy in the system and to ensure detonation of the charge. This system is referred to as dual priming. However, the system can be single primed by using only one primer 402 and/or one shock tube 106 and/or one blasting cap.

In certain examples, the shock tube adapter 104 is formed from plastic.

Operation of the shock tube adapter 104 is similar in operation and design to a magazine in a conventional firearm. An operator may load the shock tube 106 and primers 402 into the shock tube adapter 104 and may load the shock tube adapter 104 into the firing actuator 102.

The hammers 304 are cocked, and then the shock tube adaptor 104 is loaded into the firing actuator 102, and the firing device is initiated when the operator pulls the trigger 302. The trigger 302 releases the hammers 304, which cause the two firing pins 308 to engage the primers 402 to ignite the shock tube 106.

Figure 14:
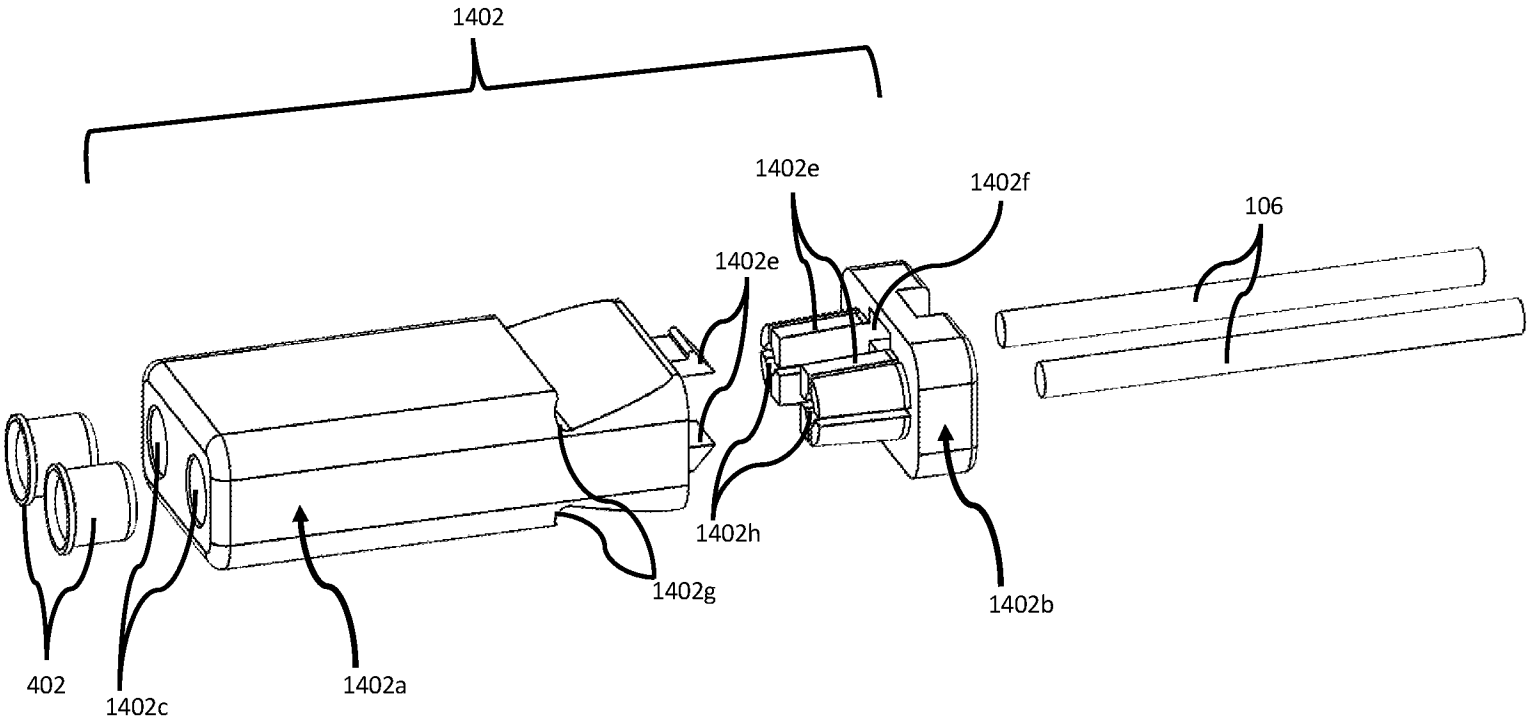
FIG. 14 is an exploded view of a second shock tube adapter, in accordance with certain examples.
Figure 15:
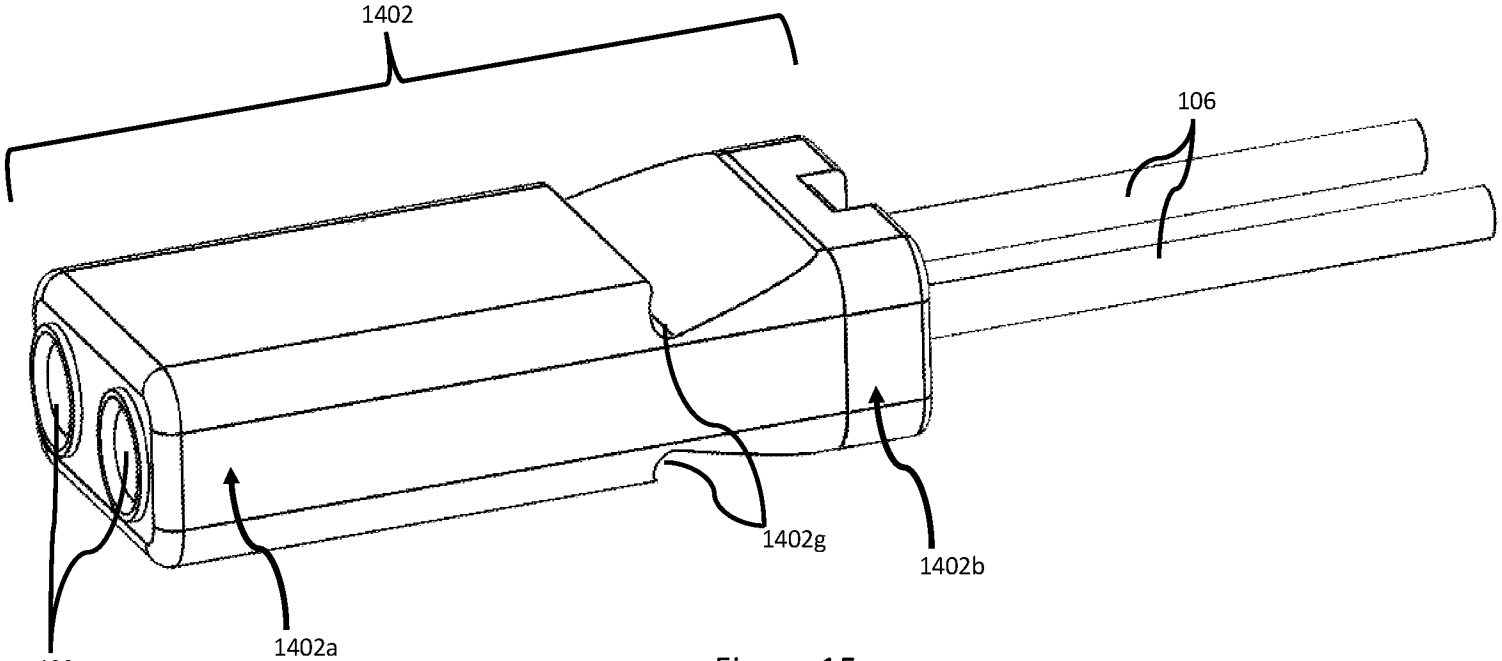
FIG. 15 is a front perspective view of an assembled second shock tube adapter, in accordance with certain examples.
Figure 16:
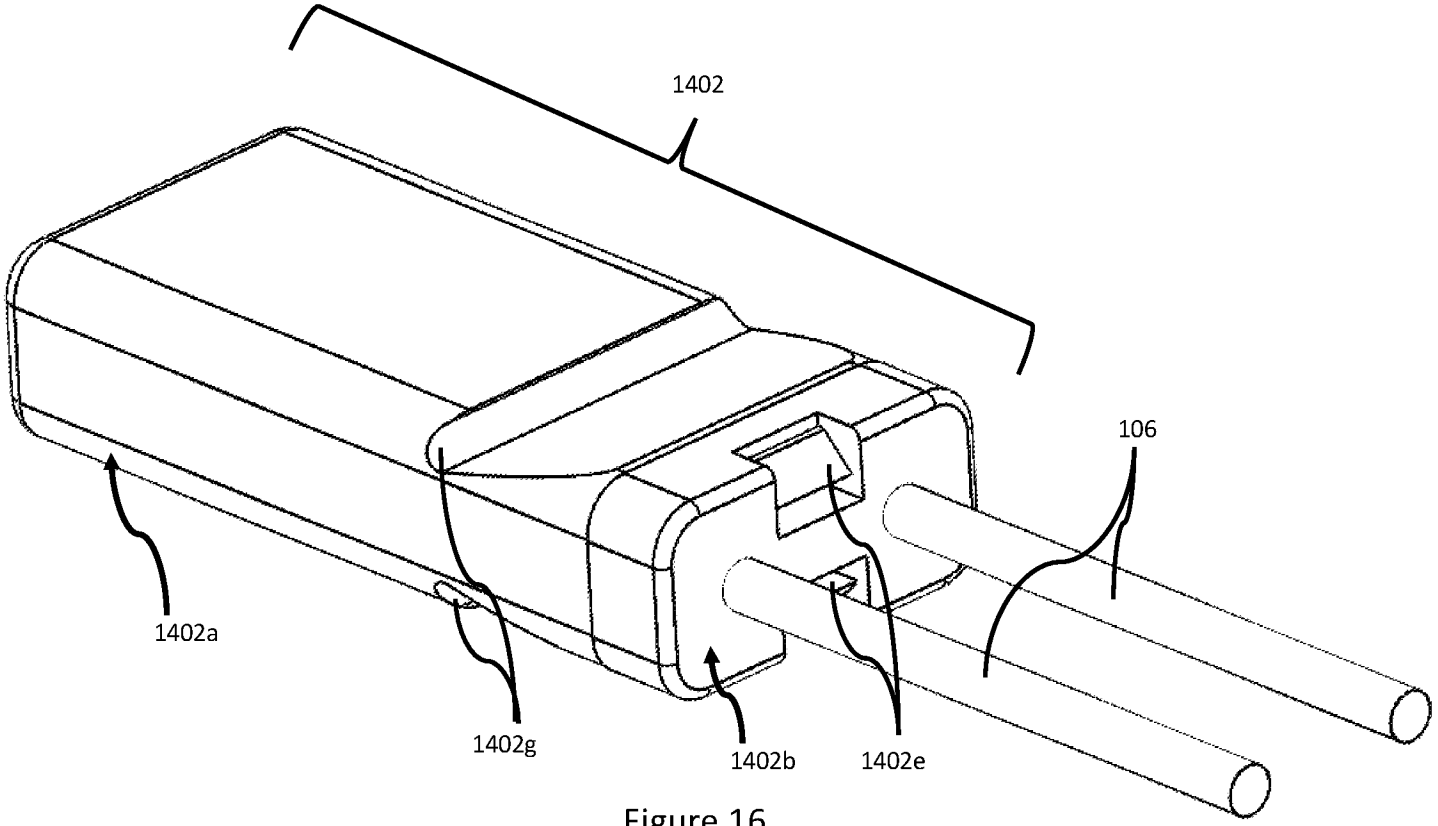
FIG. 16 is a rear perspective view of an assembled second shock tube adapter, in accordance with certain examples.
Figure 17:
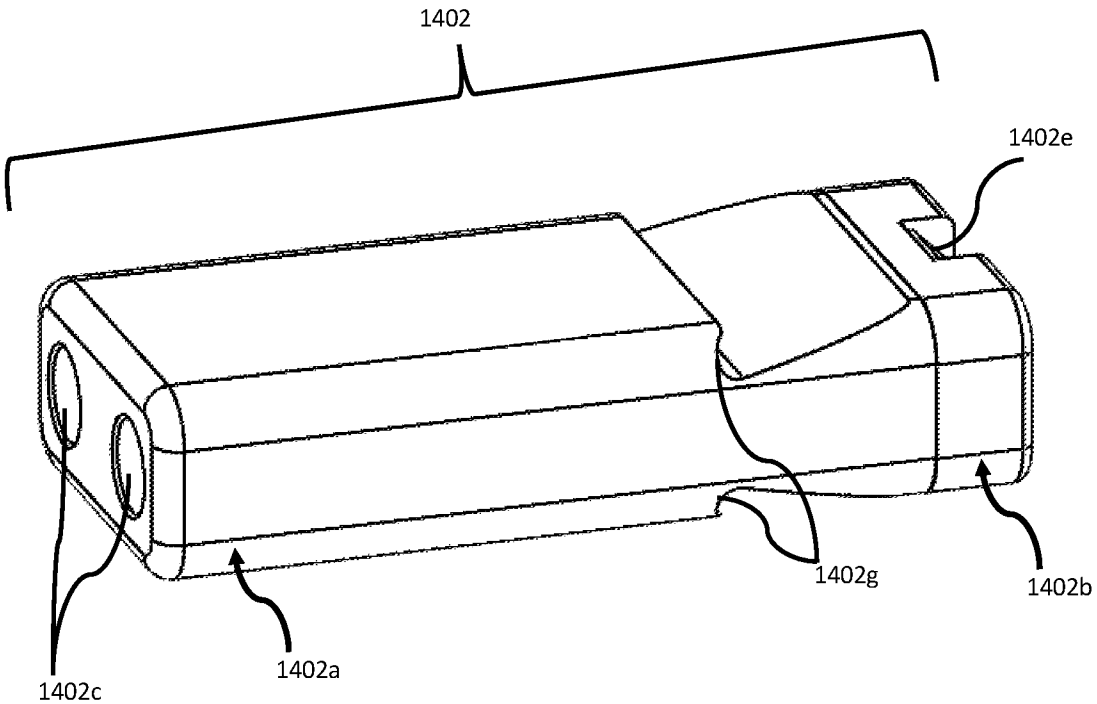
FIG. 17 is a front perspective view of an assembled second shock tube adapter without primers or shock tubes inserted therein, in accordance with certain examples.
Figure 18:
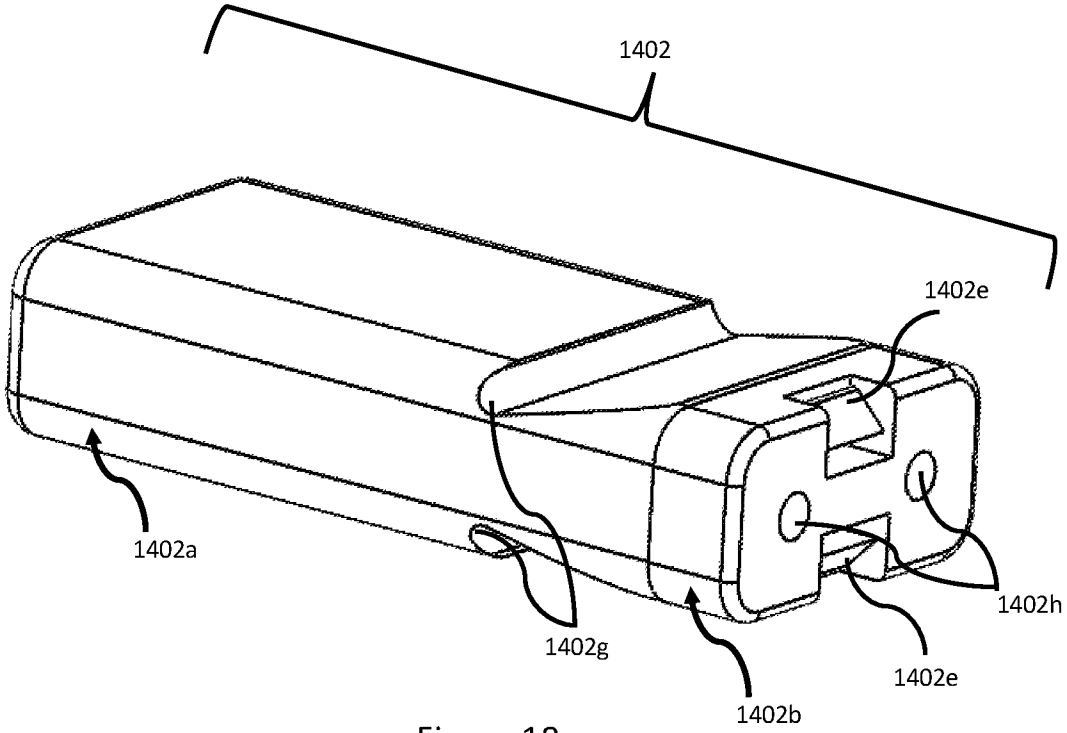
FIG. 18 is a rear perspective view of an assembled second shock tube adapter without primers or shock tubes inserted therein, in accordance with certain examples.

Additional shock tube adapters will now be described with reference to FIGS. 14-28. FIGS. 14-18 depict a second shock tube adapter in accordance with alternative examples. FIG. 14 is an exploded view of a second shock tube adapter 1402, in accordance with certain examples. FIG. 15 is a front perspective view of an assembled second shock tube adapter 1402, in accordance with certain examples. FIG. 16 is a rear perspective view of an assembled second shock tube adapter 1402, in accordance with certain examples. FIG. 17 is a front perspective view of an assembled second shock tube adapter 1402 without primers or shock tubes inserted therein, in accordance with certain examples. FIG. 18 is a rear perspective view of an assembled second shock tube adapter 1402 without primers or shock tubes inserted therein, in accordance with certain examples.

As shown in FIGS. 14-18, the second shock tube adapter 1402 comprises a primer housing 1402*a* and a shock tube compression housing 1402*b*. The primer housing 1402*a* and the shock tube compression housing 1402*b* couple together to form the shock tube adapter 1402.

The primer housing 1402*b* comprises continuous apertures 1402*c* extending through the primer housing 1402*b*. The apertures 1402*c* are sized to receive the primers 402. The apertures 1402*c* may retain the primers 402 therein via compression fit. The primers 402 also may be adhered into the apertures 1402*c*, mechanically retained therein, or otherwise fixed in position. For example, a retainer clip may be utilized to retain the primers 402 in the apertures 1402*c*. The primer apertures 1402*c* may open into an expansion chamber as discussed previously with reference to the shock tube adapter 104 leading to both shock tubes, thereby allowing either primer charge to initiate one or both shock tubes. Alternatively, the primer apertures 1402*c* may each continue directly to a respective shock tube held in the shock tube compression housing 1402*b*. In this case, each primer charge will initiate only the shock tube directly connected to the corresponding primer aperture 1402*c*.

The primer housing 1402*a* further comprises at least one retaining tab 1402*e*. Each tab 1402*e* engages a corresponding retaining indent 1402*f* in the shock tube compression housing 1402*b* to latch the primer housing 1402*a* and the shock tube compression housing 1402*b* together. The primer housing 1402*a* may include one or multiple tabs 1402*e*. For example, the primer housing 1402*a* may include two tabs 1402*e* on the top and bottom of an end that faces the shock tube compression housing 1402*b*. Alternatively, the tabs may be located on the shock tube compression housing 1402*b* and engage with corresponding indents or apertures on the primer housing 1402*a*. The shock tube compression housing comprises the one or more retaining indents 1402*f* that correspond with the retaining tabs 1402*e* of the primer housing 1402*a*. The retaining indents 1402*f* receive the retaining tabs 1402*e* to connect the shock tube compression housing 1402*b* to the primer housing 1402*a*. The operator can push the retaining tabs 1402*e* from engagement with the retaining indents 1402*f* to disconnect the shock tube compression housing 1402*b* from the primer housing 1402*a*.

The primer housing 1402*b* further comprises one or more firing actuator retaining indents 1402*g*. One retaining indent 1402*g* receives a tab 1902 (see FIG. 19) of the firing actuator 1900 (as described hereinafter with reference to FIG. 19) when the shock tube adapter 1402 is inserted into the firing actuator 1900 (as described hereinafter with reference to FIG. 19). Including the retaining indent 1402*g* on both sides of the primer housing 1402*b* allows insertion of the shock tube adapter 1402 into the firing actuator 1900 in either an up or down orientation.

The shock tube compression housing 1402*b* comprises continuous apertures 1402*h* extending through the shock tube compression housing 1402*b*. The apertures 1402*h* are sized to receive the shock tube 106.

The shock tube compression housing 1402*b* further comprises tabs 1402*d* around the apertures 1402*h*. The shock tube 106 is inserted into the apertures 1402*d* at one end of the shock tube compression housing 1402*b*, pushed through the apertures 1402*d* of the shock tube compression housing 1402*b*, and at least partially engage in the tabs 1402*d* on an opposite end of the apertures 1302*h* in the shock tube compression housing 1402*b*. The shock tube 106 may extend past the tabs 1402*d* of the shock tube compression housing 1402*b*.

The tabs 1402*d* are sized around the apertures 1402*h* to allow the shock tube 106 to pass therethrough. The tabs 1402*d* are further sized to mate in the aperture 1402*c* of the primer housing 1402*a* when the shock tube compression housing 1402*b* and the primer housing 1402*a* are attached together. As the tabs 1402*d* are inserted into the apertures 1402*c* of the primer housing 1402*a*, the apertures 1402*c* compress the tabs 1402*d* of the shock tube housing 1402*b* toward the center of the apertures 1402*h* of the shock tube compression housing 1402*b*. This movement clamps the tabs 1402*d* of the shock tube compression housing 1402*b* around the shock tube 106 in the apertures 1402*h* to retain the shock tube 106 in the shock tube compression housing 1402*b*. The apertures 1402*h* may retain the shock tube 106 therein via compression fit without extending into the tabs 1402*d*.

Connecting the shock tube compression housing 1402*b* and the primer housing 1402*a* connects the apertures 1402*h* of the shock tube compression housing 1402*b* with the apertures 1402*c* of the primer housing 1402*b* to thereby create a continuous path from the primers 402 through the apertures 1402*c* (and sometimes at least part of the apertures 1402*h*) to the shock tube 106. In this manner, an explosive wave created by initiation of the primers 402 can travel to the shock tube 106.

Various options for implementing the shock tube adapter 1402 are suitable. For example, the primer housing 1402*a* and shock tube compression housing 1402*b* may be formed integrally as a single piece. In this case, the apertures can be continuous from the end in which the primers 402 are inserted to the opposite end in which the shock tube 106 is inserted. This design also can incorporate the expansion chamber 702 (as described previously with regard to FIG. 7) between the primer end and the shock tube end of the primer housing 1402*a*. The apertures for receiving the shock tube 106 can be tapered from the end in which the shock tube 106 is inserted to a smaller area inside the shock tube compression housing 1402*b* or the primer housing 1402*a*. In this case, the shock tube adapter 1402 retains the shock tube 106 via compression as the shock tube 106 is inserted into the shock tube adapter 1402.

The two-piece design of the shock tube adapter 1402 allows a further separation of the primers 402 from the blasting caps, detonating cord 112, and the main explosive charge 114. The primer case 1402*a* can be removed from the shock tube adapter 1402 to disconnect the primers 402 from the system. The primers also can be carried separately and connected to the shock tube adapter 1402 on location. In another instance, the shock tube adapter 1402 can also be a single assembly device in which percussion caps are inserted or press fitted into the firing device end and shock tube is inserted into the explosive end and secured with either a tightening nut, a screw, or other suitable constricting device. The internal paths from the percussion caps to the shock tube can either be straight bore path from one percussion cap to one shock tube opening, or a cross-bored path that intersects or an expansion chamber to allow the explosion from one percussion cap to travel to both shock tube openings. In another instance, the shock tube adapter can be two pieces dissected horizontally creating two identical halves that snap or glue or screw together into a single piece. In this version, the shock tube adapter can have straight bore connects from the percussion caps to the shock tube, or a crossed-bored path or expansion chamber as previously described.

Figure 19:
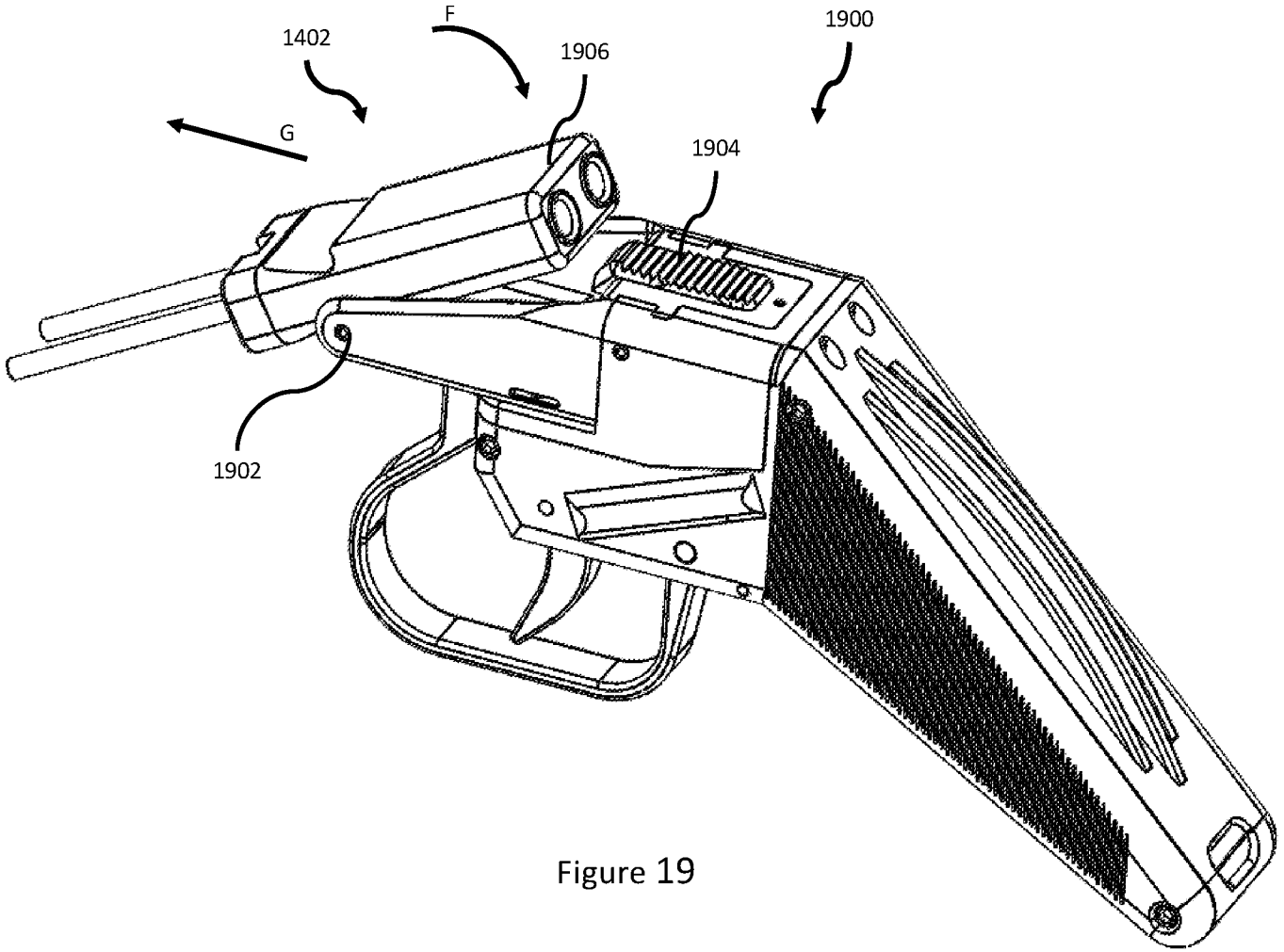
FIG. 19 is a perspective view depicting a shock tube adapter engaging with a firing actuator, in accordance with certain examples.

FIG. 19 is a perspective view depicting the shock tube adapter 1402 engaging with a firing actuator 1900, in accordance with certain examples. As shown in FIG. 19, the firing actuator 1900 comprises a shock tube adapter retaining tab 1902 that engages the retaining indent 1402*g* of the shock tube adapter 1402. Engagement of the retaining indent 1402*g* of the shock tube adapter 1402 by the retaining tab 1902 of the firing actuator 1900 allows rotation of the shock tube adapter 1402 in a direction F to engage the shock tube adapter 1402 to the firing actuator 1900.

The firing actuator 1900 further comprises a latch 1904 that is spring biased in a direction G. As the shock tube adapter 1402 is rotated in the direction F around the retaining tab 1902, the latch 1904 moves in the direction G over a top portion 1906 of the shock tube adapter 1402, thereby holding the shock tube adapter 1402 in the firing actuator 1900.

An operator may manually move the latch 1904 in a direction opposite to the direction G to allow the shock tube adapter 1402 to rotate far enough in the direction F to allow the bias force to move the latch 1904 in the direction G over the top portion 1906 of the shock tube adapter 1402. Alternatively, the shock tube adapter 1402 may push the latch 1904 in a direction opposite to the direction G as the shock tube adapter 1402 rotates in the direction F until the shock tube adapter 1402 is rotated far enough in the direction F to allow the bias force to move the latch 1904 in the direction G over the top portion 1906 of the shock tube adapter 1402. In another alternative, the latch 1904 may not be biased in the direction G. In this case, an operation may manually move the latch 1904 in a direction opposite the direction G to allow insertion of the shock tube adapter 1402 in the firing actuator 1900. The operator may then manually move the latch 1904 in the direction G to move the latch 1904 over the top portion 1906 of the shock tube actuator 1402. In each case, the latch 1904 and the retaining pin 1902 secure the shock tube adapter 1402 in the firing actuator 1900.

As shown in FIG. 19, the retaining pin 1902 is a tubular member coupled to the firing actuator 1900 and positioned to engage a length of the retaining indent 1402*g* of the shock tube adapter 1402. Any suitable configuration of the retaining pin 1902 may be used. For example, the retaining pin 1902 may be an integrally formed feature of the firing actuator 1900.

Movement of the latch 1904 and the shock tube adapter 1402 in opposite directions then described previously allows for removal of the shock tube adapter 1402 from the firing actuator 1900.

Except for insertion and removal of the shock tube adapter 1402, operation of the firing actuator 1900 is similar to operation of the firing actuator 102, as described previously with reference to FIGS. 3 and 6-7.

Figure 20:
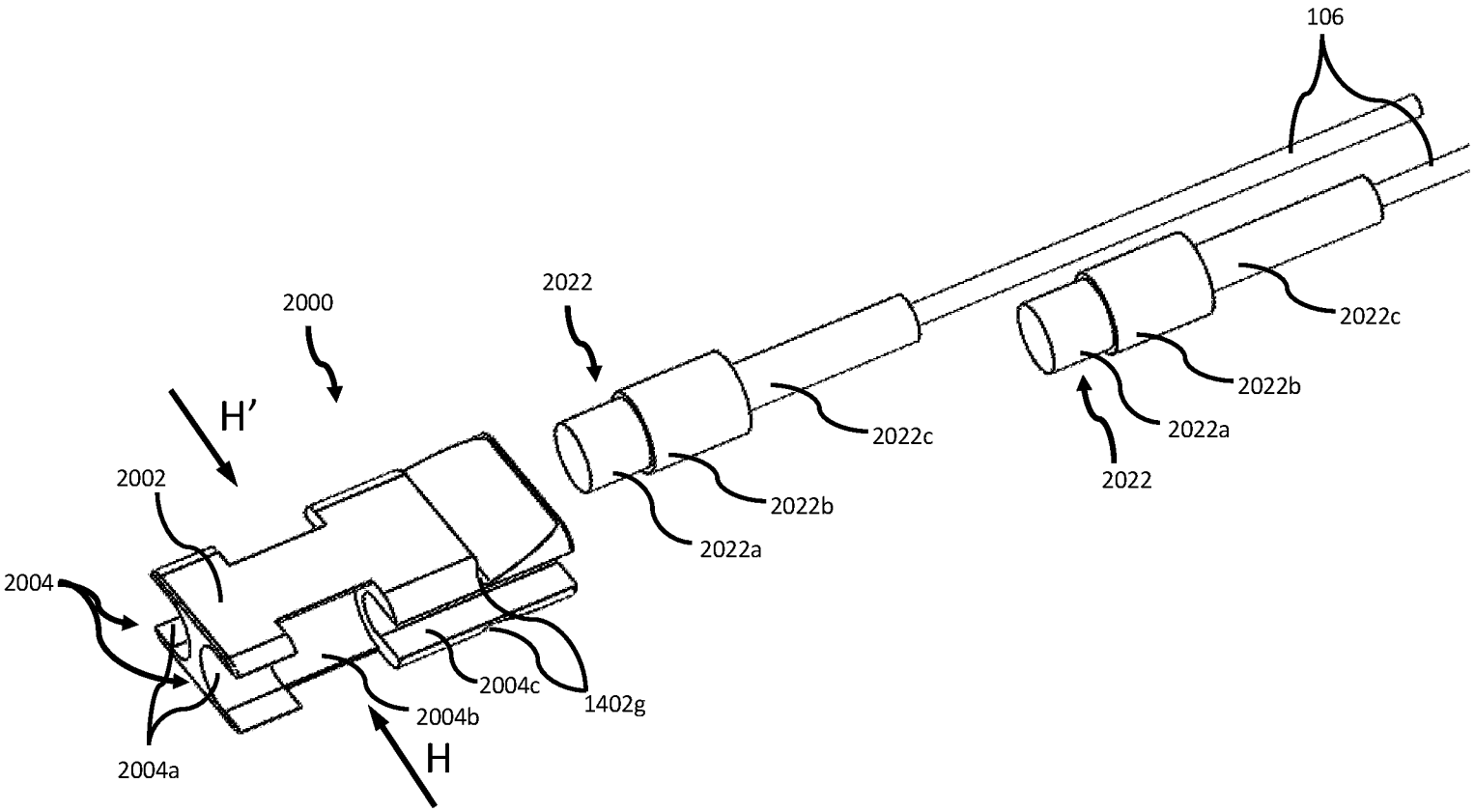
FIG. 20 is an exploded view of a third shock tube adapter, in accordance with certain examples.
Figure 21:
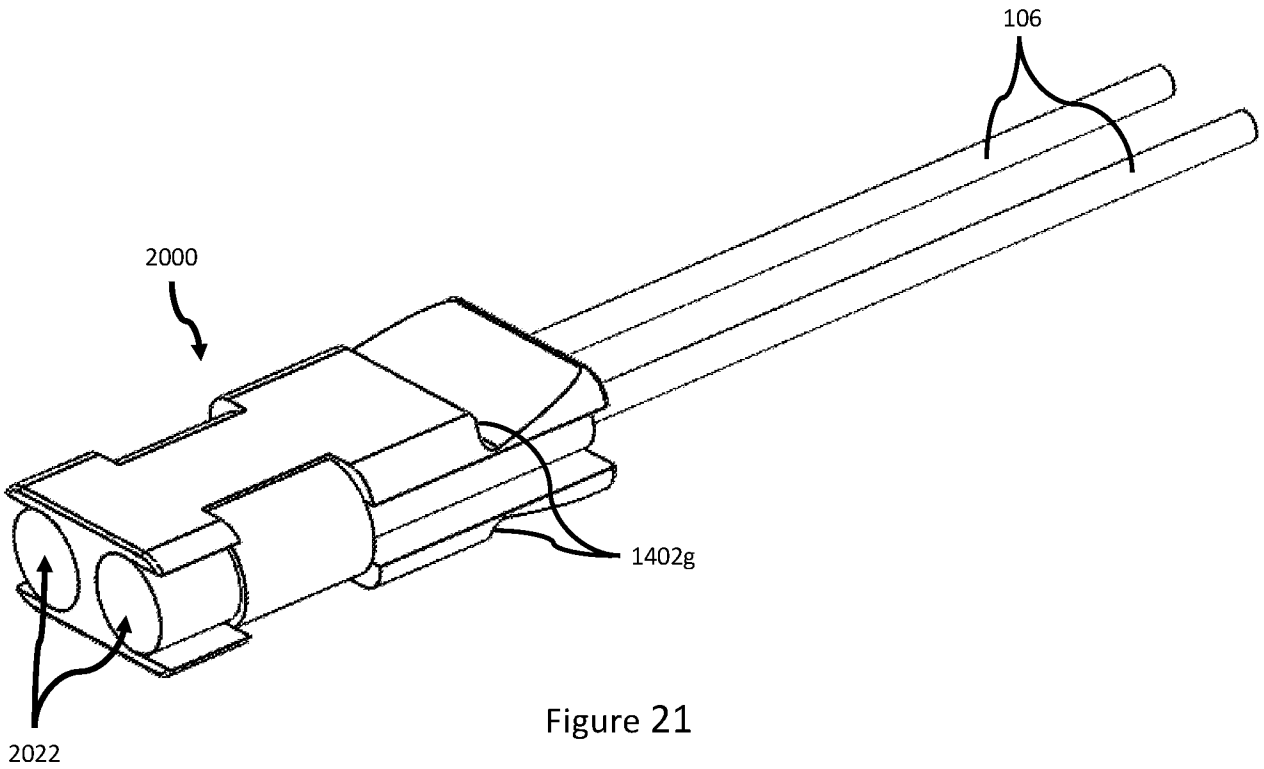
FIG. 21 is a front perspective view of an assembled third shock tube adapter, in accordance with certain examples.

FIGS. 20 and 21 depict a third shock tube adapter in accordance with alternative examples. FIG. 20 is an exploded view of a third shock tube adapter 2000, in accordance with certain examples. FIG. 21 is a front perspective view of an assembled third shock tube adapter 2000, in accordance with certain examples.

The shock tube adapter 2000 is configured to hold shock tube 106 comprising a primer housing 2022, comprising a primer therein, that is hermetically sealed or otherwise connected to the shock tube 106. The primer housing 2022 has multiple diameters at the end of the shock tube 106. As depicted in FIGS. 20-21, the primer housing 2022 has three diameters 2022*a*, 2022*b*, and 2022*c* where the primer housings 2022 are connected to the end of the shock tube 106.

As shown in FIGS. 20-21, the shock tube adapter 2000 comprises a housing 2002. The housing 2002 comprises the retaining indent(s) 1402*g* described previously with reference to the shock tube adapter 1402.

The housing 2002 also comprises apertures 2004 extending in a longitudinal direction through the housing 2002. The apertures 2004 are open along longitudinal edges of the housing 2002. Additionally, the open apertures 2004 include multiple sections 2004*a*, 2004*b*, 2004*c* that are sized to correspond to the diameters 2022*a*, 2022*b*, 2022*c*, respectively, of the primer housings 2022. A size of the edge opening of the apertures along the longitudinal edges of the housing 2002 is less than the diameter of the primer housings 2022. Accordingly, one primer housing 2022 is moved in a direction H to snap the primer housing 2022 into the housing 2002 to secure the primer housing 2022 in the housing 2002 via a compression fit. Additionally, another primer housing 2022 is moved in a direction H' to snap the other primer housing 2022 into the housing 2002 to secure the other primer housing 2022 in the housing 2002 via a compression fit. As the shock tubes 106 are already connected to the primer housings 2022, the shock tubes 106 are thereby secured to the housing 2002 of the shock tube adapter 2000.

The shock tube adapter 2000 may be used with the firing actuator 1900 described previously with reference to FIG. 19. Specifically, the retaining indent 1402*g* of the shock tube adapter 2000 engages with the retaining pin 1902 of the firing actuator 1900 to secure the shock tube adapter 2000 to the firing actuator 1900.

Figure 22:
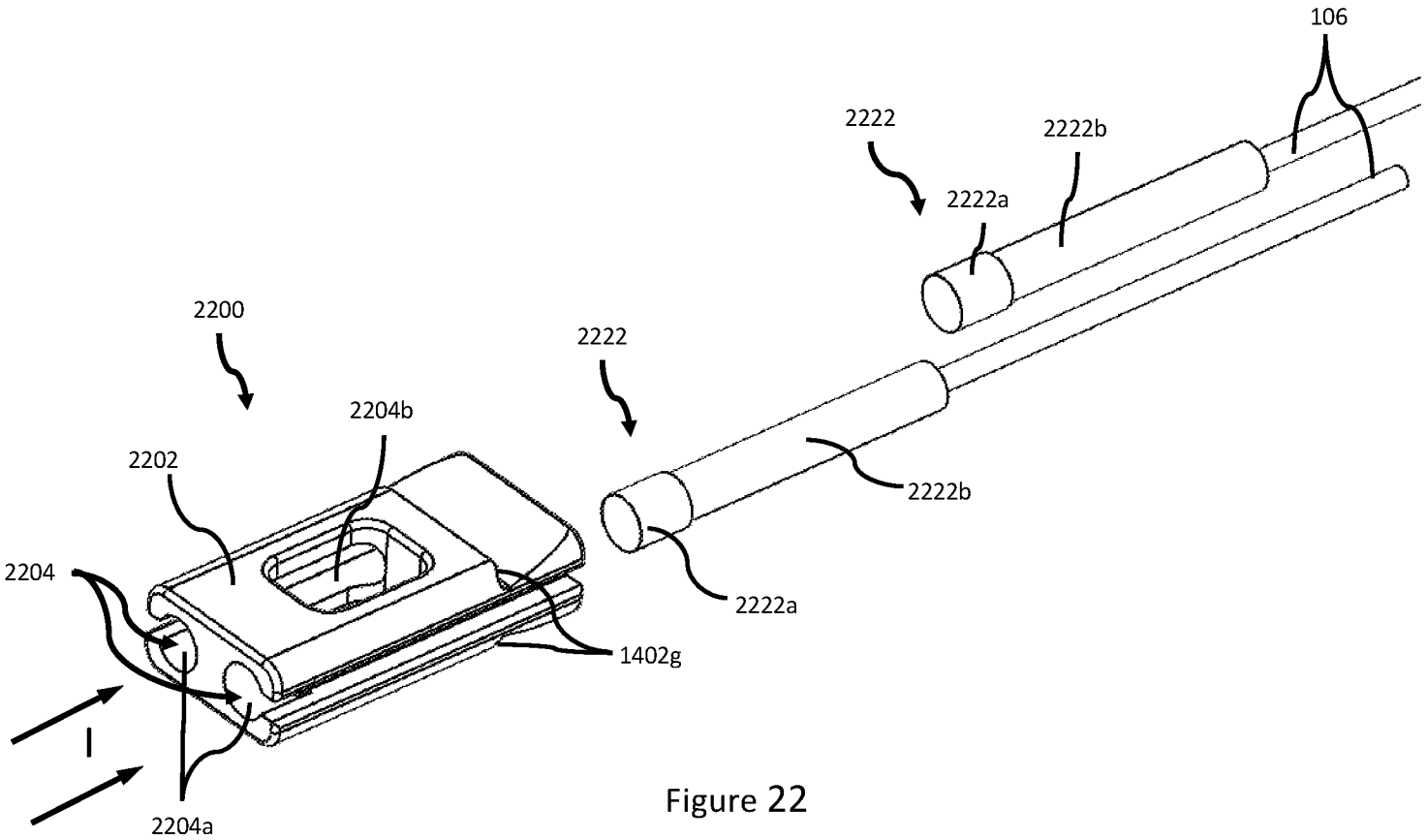
FIG. 22 is an exploded view of a fourth shock tube adapter, in accordance with certain examples.
Figure 23:
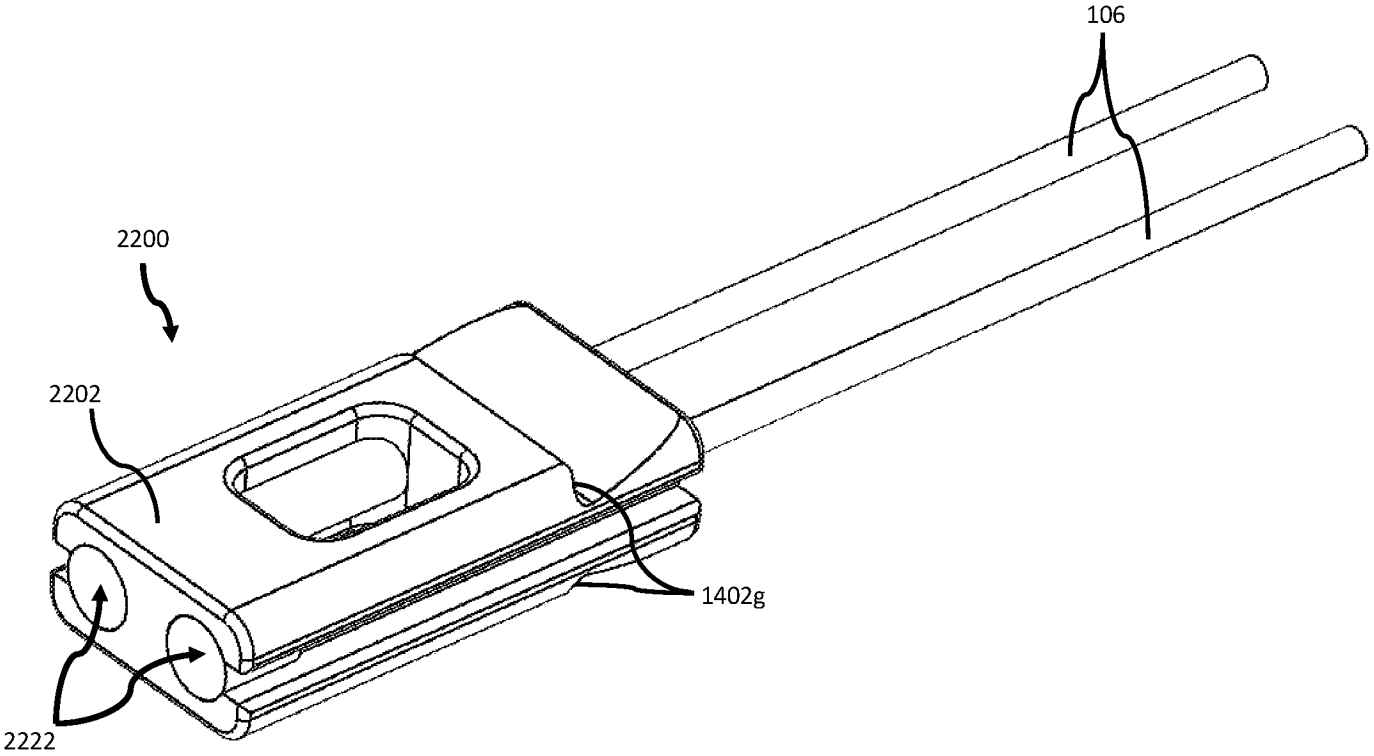
FIG. 23 is a front perspective view of an assembled fourth shock tube adapter, in accordance with certain examples.

FIGS. 22 and 23 depict a fourth shock tube adapter in accordance with alternative examples. FIG. 22 is an exploded view of a fourth shock tube adapter 2200, in accordance with certain examples. FIG. 23 is a front perspective view of an assembled fourth shock tube adapter 2200, in accordance with certain examples.

The shock tube adapter 2200 is configured to hold shock tube 106 comprising a primer housing 2222, comprising a primer, that is hermetically sealed or otherwise connected to the shock tube 106. The primer housing 2222 has multiple diameters at the end of the shock tube 106. As depicted in FIGS. 22-23, the primer housing 2222 has two diameters 2222*a*, 2222*b* where the primer housings 2222 are connected to the end of the shock tube 106.

As shown in FIGS. 22-23, the shock tube adapter 2200 comprises a housing 2202. The housing 2202 comprises the retaining indent(s) 1402*g* described previously with reference to the shock tube adapter 1402.

The housing 2202 also comprises apertures 2204 extending in a longitudinal direction through the housing 2202. The apertures 2204 are open along longitudinal edges of the housing 2202. Additionally, the open apertures 2204 include multiple sections 2204*a*, 2204 that are sized to correspond to the diameters 2222*a*, 2222*b*, respectively, of the primer housings 2222. A size of the edge opening of the apertures along the longitudinal edges of the housing 2202 is less than the diameter of the primer housings 2222.

In operation, the shock tubes 106 are inserted through the edge openings of the apertures 2204. Then, the shock tubes 106 are pulled in a direction I until the primer housing 2222 engage the apertures 2204 to secure the primer housing 2222 in the shock tube adapter 2200. As the shock tubes 106 are already connected to the primer housing 2222, the shock tubes 106 are thereby secured to the housing 2202 of the shock tube adapter 2200.

Alternatively, similarly to insertion of the primer housings 2022 into the shock tube adapter 2000 described previously with reference to FIGS. 20-21, one primer housing 2222 is moved in a direction H to snap the primer housing 2222 into the adapter housing 2202 to secure the primer housing 2222 in the housing 2202 via a compression fit. Additionally, another primer housing 2222 is moved in a direction H' to snap the other primer housing 2222 into the housing 2202 to secure the other primer housing 2222 in the adapter housing 2202 via a compression fit. As the shock tubes 106 are already connected to the primer housing 2222, the shock tubes 106 are thereby secured to the adapter housing 2202 of the shock tube adapter 2200.

The shock tube adapter 2200 may be used with the firing actuator 1900 described previously with reference to FIG. 19. Specifically, the retaining indent 1402*g* of the shock tube adapter 2200 engages with the retaining pin 1902 of the firing actuator 1900 to secure the shock tube adapter 2200 to the firing actuator 1900.

Figure 24:
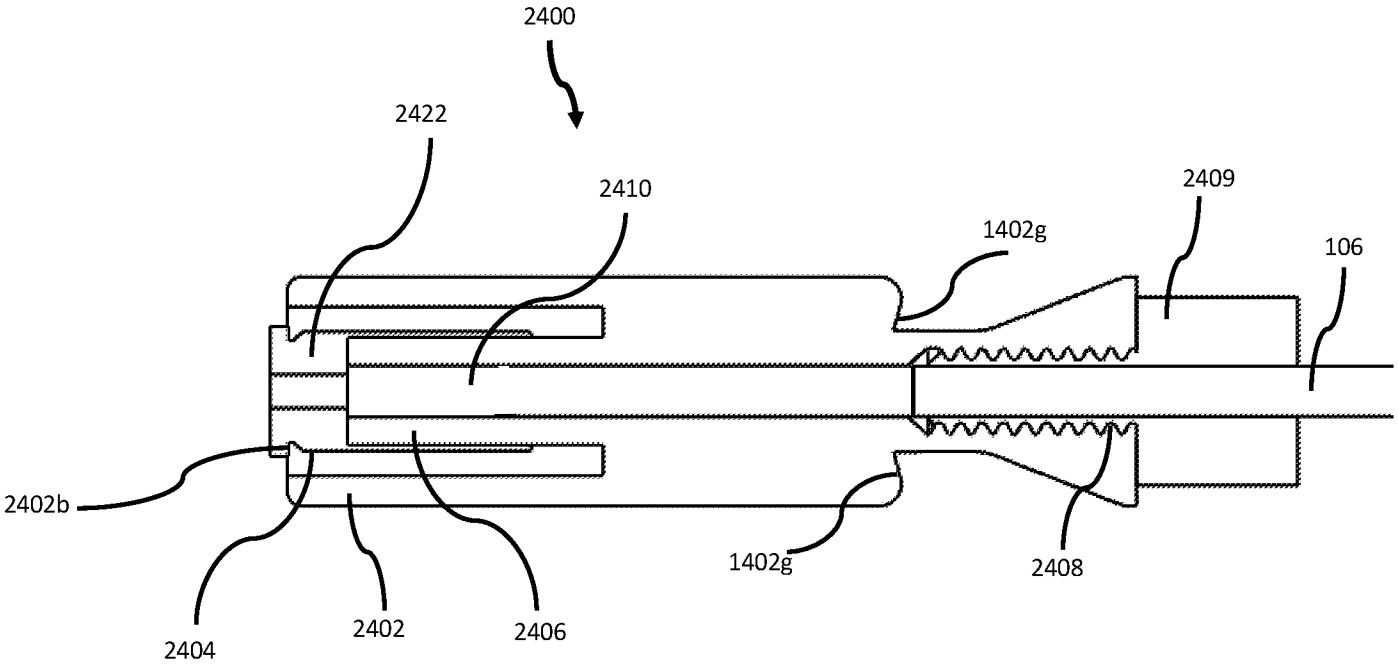
FIG. 24 is a cross-sectional view of a fifth shock tube adapter, in accordance with certain examples.
Figure 25:
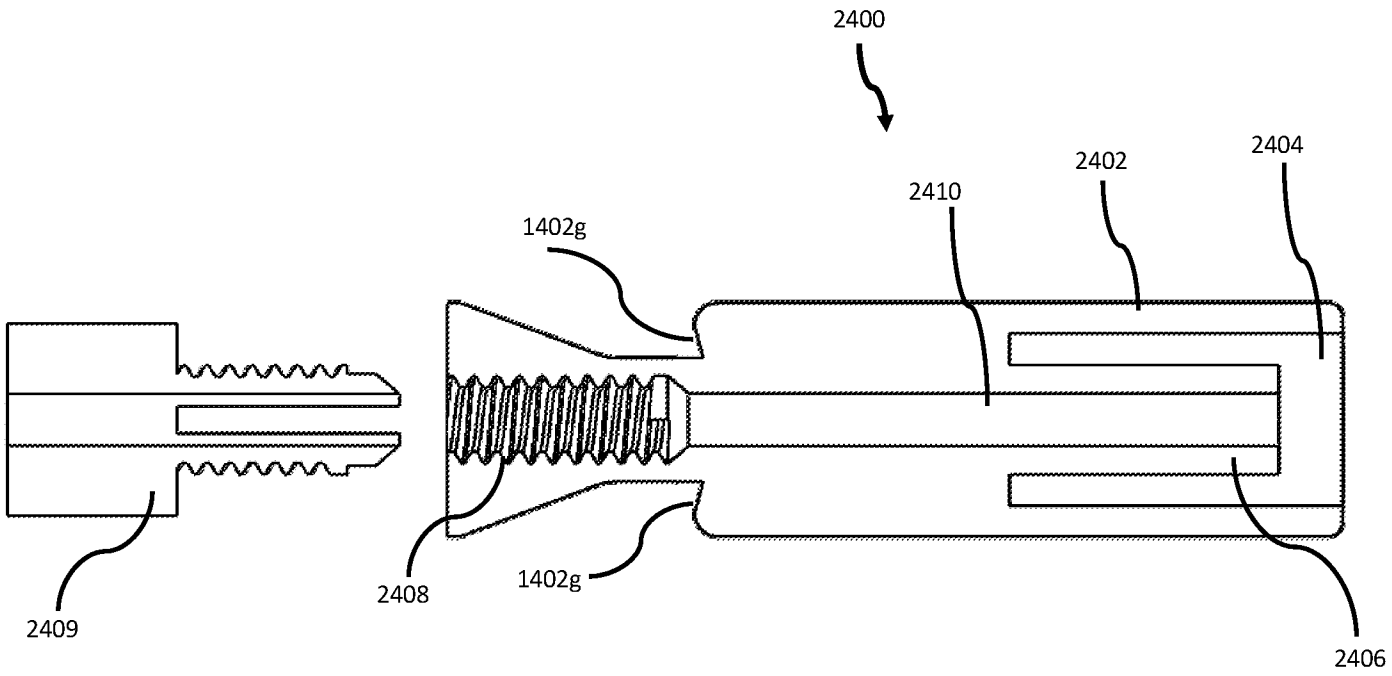
FIG. 25 is a cross-sectional view of the fifth shock tube adapter without a primed cartridge combination or shock tube inserted therein, in accordance with certain examples.

FIGS. 24 and 25 depict a fifth shock tube adapter in accordance with alternative examples. FIG. 24 is a cross-sectional view of a fifth shock tube adapter 2400, in accordance with certain examples. FIG. 25 is a cross-sectional view of the fifth shock tube adapter 2400, without a primed cartridge or shock tubes inserted therein in accordance with certain examples.

The shock tube adapter 2400 is configured to accept a primed cartridge case combination of standard caliber ammunition. The standard caliber may be 9 mm, 25 caliber ACP, 38 special, or any other suitable caliber. Corresponding components of the shock tube adapter 2400 are sized to accommodate the desired caliber.

Although not depicted in previous figures, the primed cartridge combination of standard caliber ammunition may be used as the primers for any of the shock tube adapters discussed herein.

As shown in FIGS. 24-25, the shock tube adapter 2400 comprises a housing 2402. The housing 2402 comprises the retaining indent(s) 1402*g* described previously with reference to the shock tube adapter 1402.

The housing 2402 also comprises shock tube apertures 2408 on one end of the housing 2402. The shock tube apertures 2408 are each threaded to receive and retain a compression fitting 2409 with shock tube 106 therein. The shock tubes 106 are retained with compression fitting 2409 that receive the shock tube through an opening in the center of a round nut. The shock tube 106 passes through the center of the nut into a hollow screw that is slotted and chamfered to allow compression of the shock tube as the fitting 2409 is screwed into the apertures 2408. The shock tube is inserted to line up with the end of the compression fitting 2409 and then threaded into the housing aperture 2408. However, the shock tube may be inserted less or farther as desired.

An end of the housing 2402 opposite the shock tube apertures 2408 comprises primer apertures 2404. The primer apertures 2404 are sized to accommodate a primed cartridge case 2422 corresponding to a desired caliber of ammunition, for example, 9 mm, 38 special, 25 caliber ACP, or any suitable caliber. The primer apertures 2404 may hold the primed cartridge 2422 via any suitable method, such as compression fit. The housing 2402 also may comprise tabs 2402*b* around an opening into the apertures 2404. The tabs 2402*b* engage a corresponding groove around a shell of the primed cartridge 2422. That engagement may hold the primed cartridge 2422 in the apertures 2404.

Each primer aperture 2404 extends around an inner tubular structure 2406 such that the shell of the primed cartridge 2422 is inserted into the primer aperture 2404 and over the inner tubular structure 2406. An outer diameter of the inner tubular structure 2406 can be sized to correspond to an inner diameter of the shell of the primed cartridge 2422. The inner tubular structure 2406 also may assist retention of the shell in the housing 2402 via compression fit of the shell around the inner tubular structure 2406.

An interior tubular aperture 2410 of the inner tubular structure 2406 extends through the housing 2402 to the primer aperture 2406.

A gas jet caused by initiation of the primer of the primed cartridge 2422 will travel from the primer, through the shell, through the interior tubular aperture 2410 of the inner tubular structure 2406, to the shock tube 106, thereby initiating the shock tube 106.

The shock tube adapter 2400 may be used with the firing actuator 1900 described previously with reference to FIG. 19. Specifically, the retaining indent 1402*g* of the shock tube adapter 2400 engages with the retaining pin 1902 of the firing actuator 1900 to secure the shock tube adapter 2400 to the firing actuator 1900.

Using primed cartridges of standard caliber ammunition can simplify logistics for a breaching system. Special primers do not need to be purchased and/or stored. Primed cartridges may be acquired in a caliber that is typically used by the operator of the breaching system. For example, a law enforcement agency that uses standard 9 mm ammunition may acquire extra primed cartridges as components when purchasing standard ammunition of the same caliber. The law enforcement agency also can acquire shock tube adapters 2400 sized to accommodate the same caliber. Additionally, an operator in the field may remove the bullet and powder from a standard ammunition round, and use the remaining primed cartridge combination as the primer with the shock tube adapter 2400.

The shock tube adapter 104 also may be adapted with firing actuator retaining indents 1402*g* to be used with the firing device 1900 as described herein with reference to FIG. 19.

Figure 8:
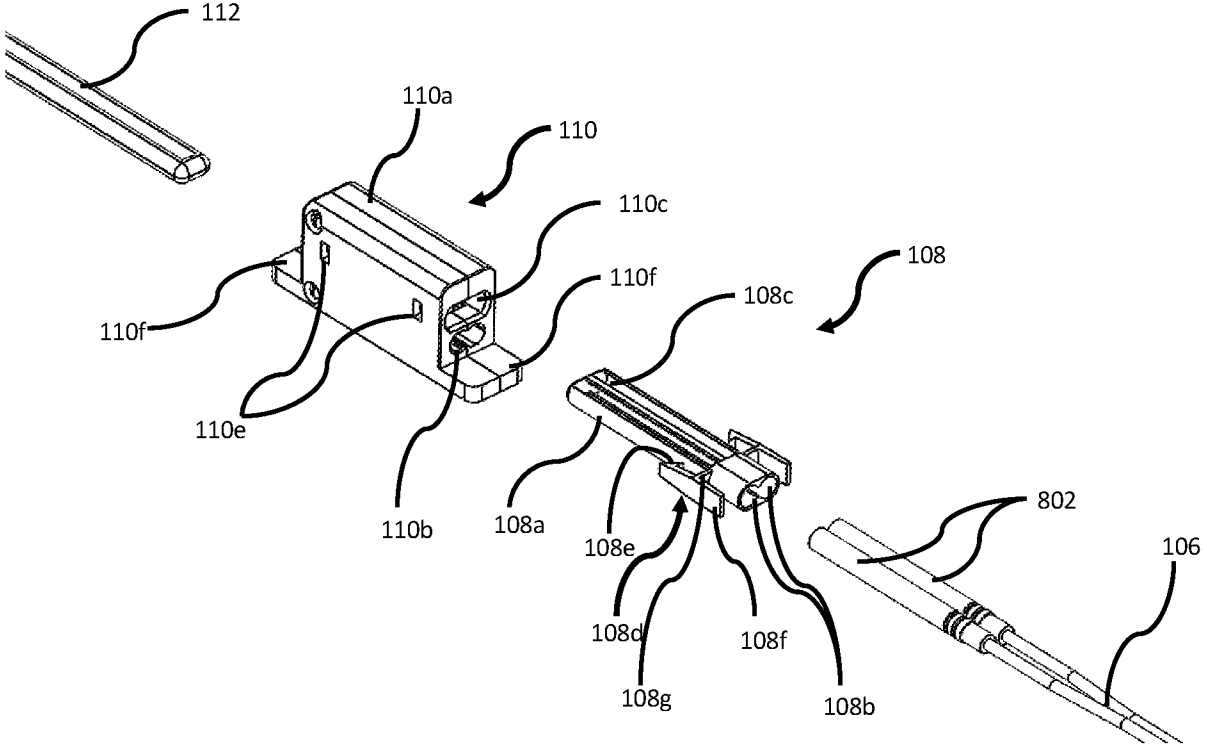
FIG. 8 is an assembly diagram depicting the blasting caps, cap box, priming well, and detonating cord in position for assembly, in accordance with certain examples.
Figure 9:
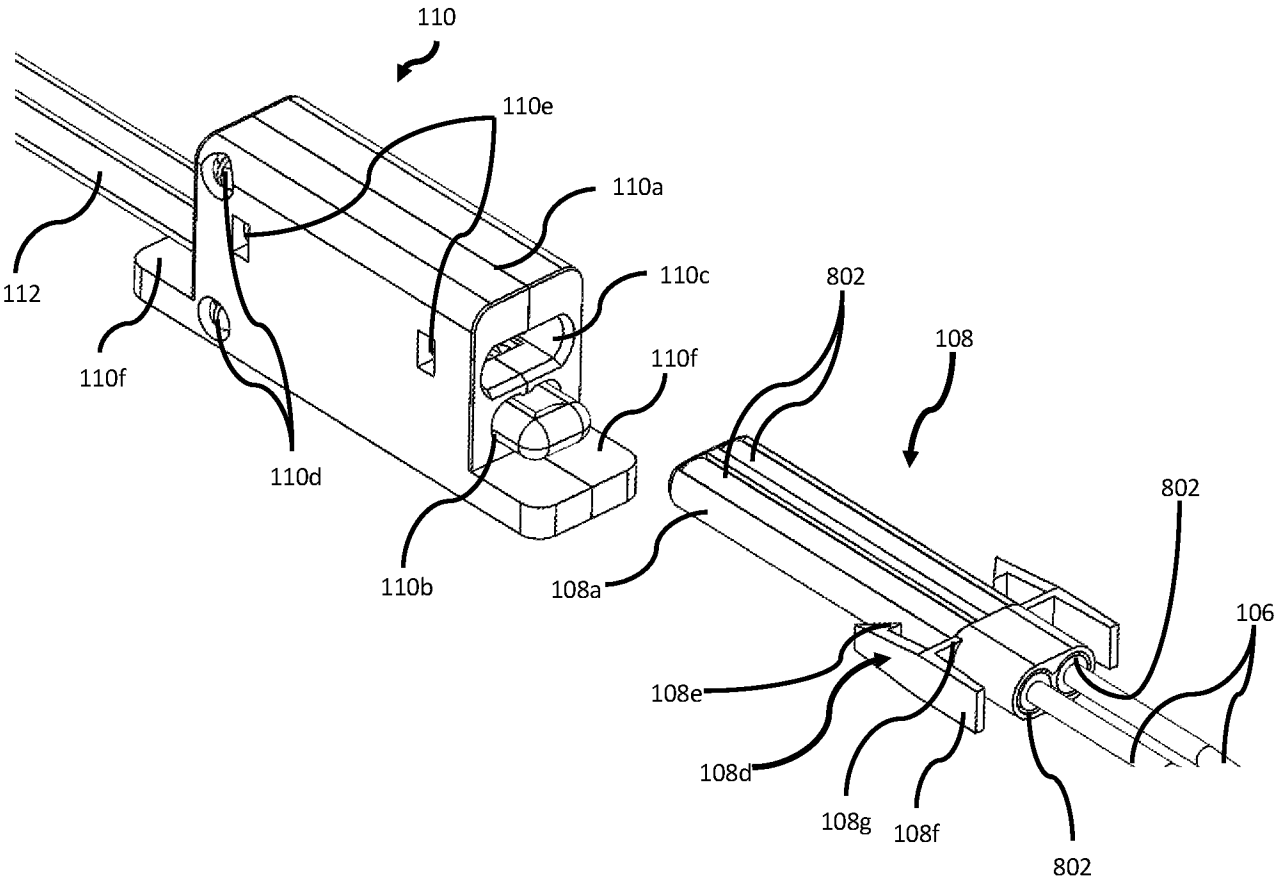
FIG. 9 is an assembly diagram depicting insertion of the detonating cord in the priming well and insertion of the blasting caps in the cap box, in accordance with certain examples.
Figure 10:
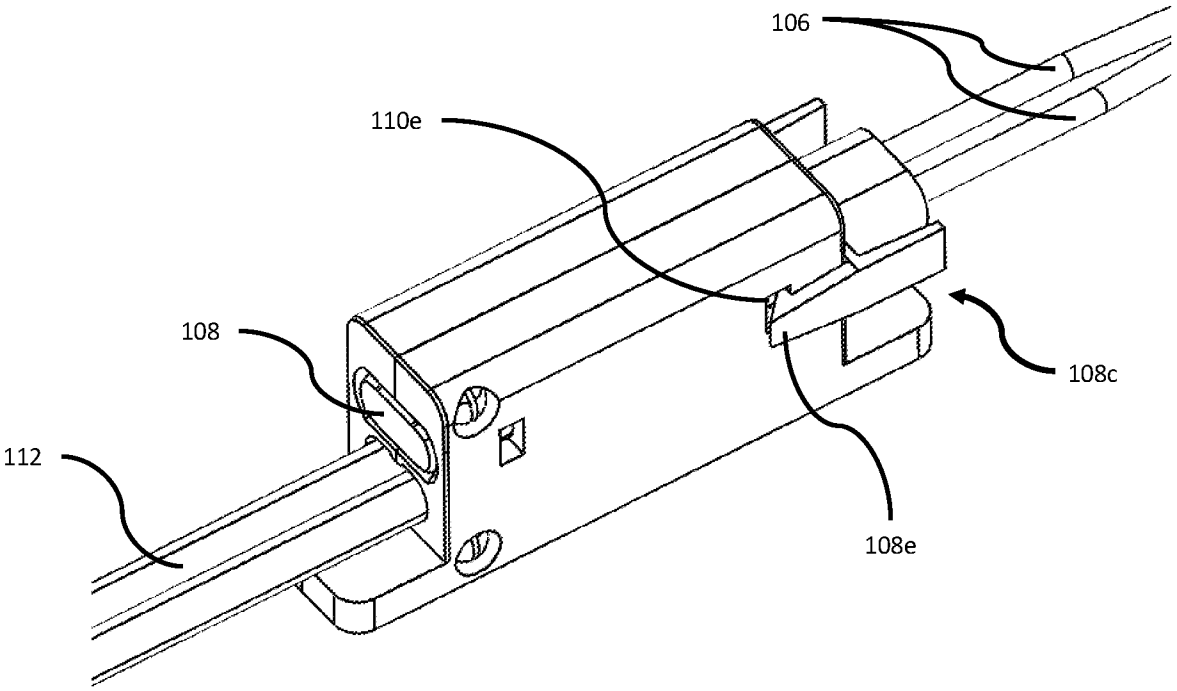
FIG. 10 is an assembly diagram depicting the blasting caps/cap box and the detonating cord inserted into the priming well, in accordance with certain examples.
Figure 11:
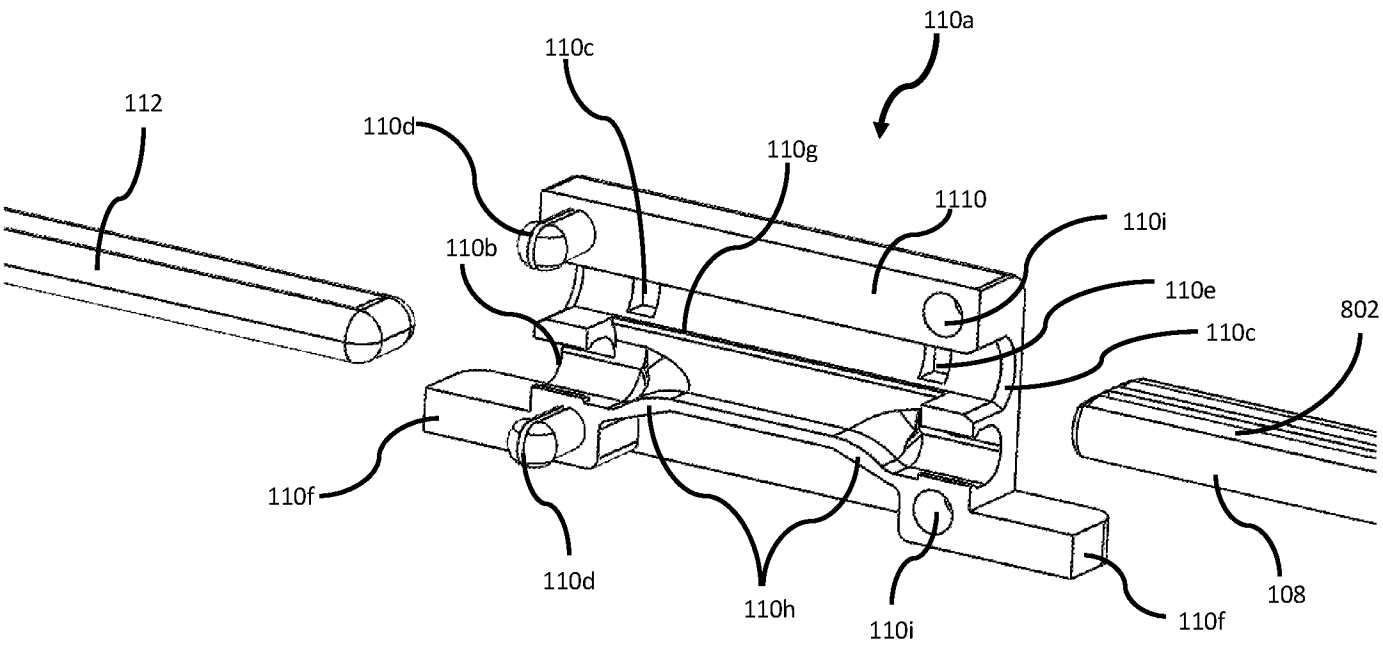
FIG. 11 is a perspective view of one half of a priming well, in accordance with certain examples, in accordance with certain examples.

The priming well 110 will now be described with reference to FIGS. 8-11. FIG. 8 is an assembly diagram depicting the blasting caps 802, cap box 108, priming well 110, and detonating cord 112 in position for assembly, in accordance with certain examples. FIG. 9 is an assembly diagram depicting insertion of the detonating cord 112 in the priming well 110 and insertion of the blasting caps 802 in the cap box 108, in accordance with certain examples. FIG. 10 is an assembly diagram depicting the blasting caps/cap box 108 and the detonating cord 112 inserted into the priming well 110, in accordance with certain examples. FIG. 11 is a perspective view of one half of a priming well 110, in accordance with certain examples.

The blasting caps 802 are attached to an end of the shock tube 106. For example, the blasting caps 802 can be crimped to the end of the shock tube 106.

The blasting caps 802 are inserted in to the cap box 108. The cap box 108 allows connecting and disconnecting the blasting caps 802 into the priming well 110. The cap box 108 also protects the blasting caps 802 during storage and/or transport. Although not depicted in FIG. 8, the cap box can comprise the removeable cap or other cover that further covers and protects the blasting caps from being struck during transport. This protection can maintain the blasting caps 802 in proper working condition. This protection also can prevent an inadvertent detonation of the blasting caps 802 by accidental contact or abuse.

The cap box 108 comprises a cap box housing 108*a* having apertures 108*b* extending from a first end of the cap box housing 108*a* through the cap box housing 108*a*. The apertures 108*b* are open to an exterior of the cap box housing 108*a* as shown by reference numeral 108*c*. A second end of the cap box housing 108*a* is closed. However, the apertures 108*b* may continue through the second end of the cap box housing 108*a*.

The blasting caps 802 are inserted into the apertures 108*b* of the cap box housing 108*a* until the blasting caps 802 are positioned inside the cap box housing 108*a*. The cap box housing 108*a* may retain the blasting caps 802 via compression fit. The cap box housing may also, or alternatively, retain the blasting caps 802 via retaining tabs (not depicted in FIGS. 8-11) located at the opening of the apertures 108*b* into the cap box housing 108*a*. In this case, the blasting caps 802 move the retaining tabs outward during insertion of the blasting caps 802 into the cap box housing 108*a*, and the tabs spring around the end of the blasting caps 802 to hold the blasting caps 802 in position.

The cap box 108 further comprises one or more cap box retaining latches 108*d* coupled to the cap box housing 108*a*. The cap box retaining latches 108*d* can be integrally formed with the cap box housing 108*a* and connect to the cap box housing 108*a* at a pivot point 108*g*. The cap box retaining latches 108*d* further comprise a locking tab 108*e* at one end. The cap box retaining latches 108*d* may further comprise a lever tab 108*f* Actuation of the lever tab 108*f* moves the cap box retaining latch 108*d* about the pivot point 108*g* to move the locking tab 108*e* away from the cap box housing 108*a*.

In certain examples, the cap box 108 is a single, plastic part that houses the two blasting caps 802 and the end of the shock tube 106. The cap box 108 may be 3D printed or produced by any other plastic manufacturing process.

The cap box 108 serves at least three purposes. First, the cap box 108 provides a quick connect/disconnect to insert the blasting caps 802 into the priming well 110. Second, the cap box 108 protects the ends of the blasting caps 802, which are subject to exploding when struck on a hard surface. The cap box also can be inserted into a protective cover in a fast, disconnectable fashion.

The top and bottom of the cap box 108 are typically left open to allow the blasting caps 802 to have intimate contact with the detonating cord 112 when the cap box 108 is inserted into the priming well 110. The contact allows the blasting caps 802 to ignite the detonating cord 112 more efficiently and reliably. However, the top and bottom of the cap box 108 do not have to be left open for the system to operate.

The priming well 110 comprises a priming well housing 110*a* having a continuous aperture 110*b* and a continuous aperture 110*c* extending therethrough. The aperture 110*b* receives the detonating cord 112. The aperture 110*c* receives the cap box 108. The apertures 110*b* and 110*c* are oriented such that insertion of the detonating cord 112 in aperture 110*b* and insertion of the cap box 108 in the aperture 110*c* places the detonating cord 112 and the blasting caps 802 in proximity to each other. The detonating cord 112 may contact the blasting caps 802 or otherwise be located at a distance that will allow detonating of the blasting caps 802 to ignite the detonating cord 112.

The priming well 110 further comprises one or more indents (or apertures) 110*e* that receive the lever tab 108*f* of the cap box latch 108*d* as the cap box 108 is inserted into the aperture 110*c* of the priming well 110. In this manner, the cap box 108 can be inserted in and retained by the priming well 110. Additionally, the cap box 108 can be removed from the priming well 110 by action of the lever tab 108*f* away from the priming well 110 to release the lever tab 108*e* from the indent 110*e* of the priming well 110.

The priming well housing 110*a* may comprise protrusions 110*f* extending from the priming well housing. These protrusions 110*f* can facilitate attaching the priming well 110 to the detonating cord 112, the main explosive charge 114, or other fixture near the desired location. For example, zip ties, straps, plastic tape, rope, or other suitable material may be utilized with the protrusions 110*f* to hold the priming well 110 in a desired position.

As shown in FIGS. 9-11, the priming well 110 can be formed in two halves, whereby the housing 110*a* comprises two components 1110 configured to attach together to form the priming well housing 110*a*. Each component 1110 may comprise one or more locking tabs 110*d* that mate with another component 1110 to lock the two halves 1110 together. FIG. 11 depicts one-half 1110 of a two-piece priming well 110 in more detail. In addition to the priming well 110 components discussed previously, FIG. 11 depicts additional features internal to the priming well 110.

Each component 1110 of the priming well housing 110*a* also comprises retaining apertures 110*i* that receive corresponding locking tabs 110*d* of the other component 1110 of the priming well housing 110*a* to lock the two halves of the priming well housing 110*a* together. The apertures 110*b* and 110*c* are open to each other internally in the priming well 110 as shown by reference number 110*g*. This opening allows the detonating cord 112 to be positioned in proximity to the blasting caps 802 when the detonating cord 112 and the blasting caps 802 are inserted into the priming well 110. Two components 1110 can be mated together to form the complete housing 110*a* of the priming well 110.

The aperture 110*b* comprises one or more sloping portions 110*h* that are angled toward the aperture 110*c*. As the detonating cord 112 is inserted into the aperture 110*b* of the priming well 110, the sloping portions 110*h* force the detonating cord 112 toward the blasting caps 802. The positioning can ensure that the detonating cord 112 is positioned in sufficient proximity to the blasting caps 802 to allow detonation of the detonating cord 112 by the blasting caps 802. The sloping configuration of the bottom of the priming well 110 forces the detonating cord 112 upward into close proximity to the blasting caps 802, which may include contact with the blasting caps 802. The close proximity and/or intimate contact created by the forcing together of the detonating cord 112 and the blasting caps 802 causes the ignition of the detonating cord 112 by the blasting caps 802 to be more reliable and efficient. The likelihood that the blasting caps 802 will fail to ignite the detonating cord 112 can be reduced.

The cap box 108 can be plugged into the priming well 110 from any orientation and direction allowing the operator to quickly and intuitively connect the entire explosive system and back away to a safe location. The priming well 110 is designed with redundant configurations on both ends of the priming well 110. Accordingly, the operator may insert the cap box 108 in either end of the priming well 110 and may insert the detonating cord 112 in either end of the priming well 110. A simpler design also is suitable. For example, the priming well 110 can be configured on one end to receive only the cap box 108 and on another end to receive only the detonating cord 112.

The priming well 110 can retain the detonating cord 112 via a compression fit. For example, an area of the aperture 100*b* can taper to a smaller area inside the priming well 110 such that insertion of the detonating cord 112 compresses the detonating cord 112 inside the aperture 110*b*. Another method of securing the detonating cord comprises annular ridges along the length of the detonation chord path through the Priming well to physically engage the detonation cord.

Other configurations of the priming well 110 are suitable. For example, if the cap box 108 is not used, the aperture 110*c* can be sized to directly accommodate the blasting caps 802. The blasting caps 802 and/or the cap box 108/blasting caps 802 combination can be stored and/or transported in the priming well 110. In this manner, the priming well 110 can protect the blasting caps 802 during storing and or transport.

The aperture 110*b* can be formed without the sloping portions 110*h*. In this case, the apertures 110*b* and 110*c* can be formed such that the detonating cord 112 and blasting caps 802 are positioned in suitable proximity without forcing the detonating cord 112 toward the blasting caps 802. The priming well 110 can be formed without the protrusions 110*f*. The priming well 110 can be formed as a single-piece construction.

Figure 12:
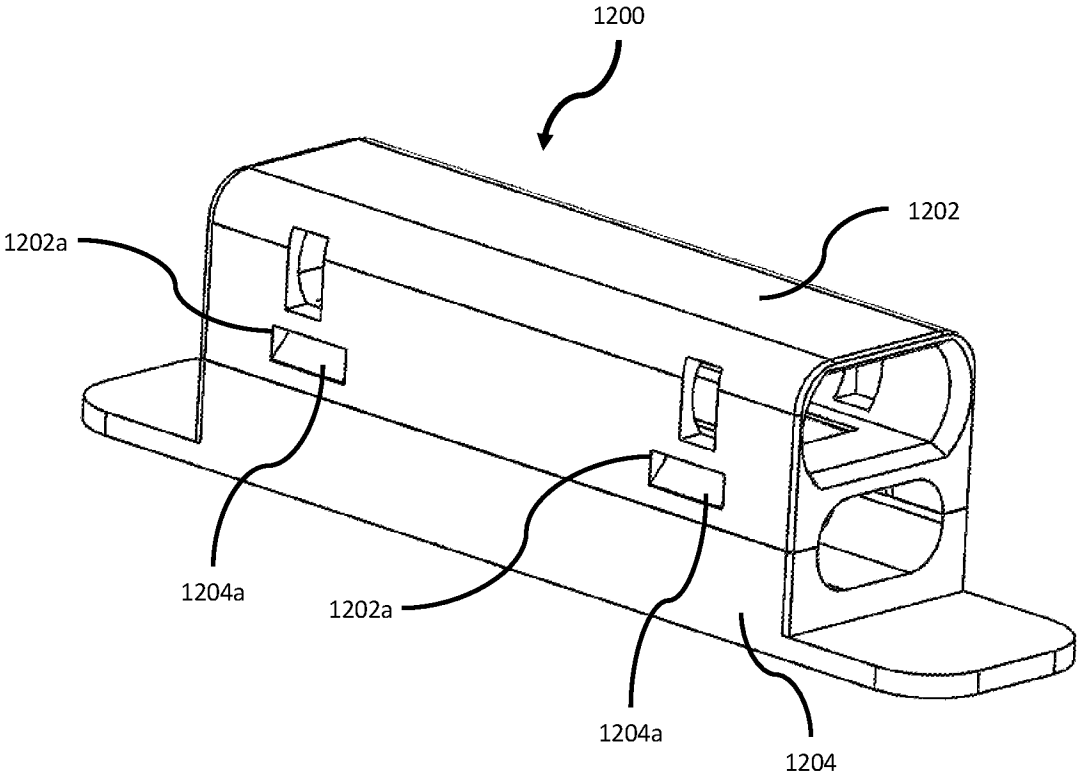
FIG. 12 is a perspective view depicting a low profile version of a priming well, in accordance with certain examples.
Figure 13:
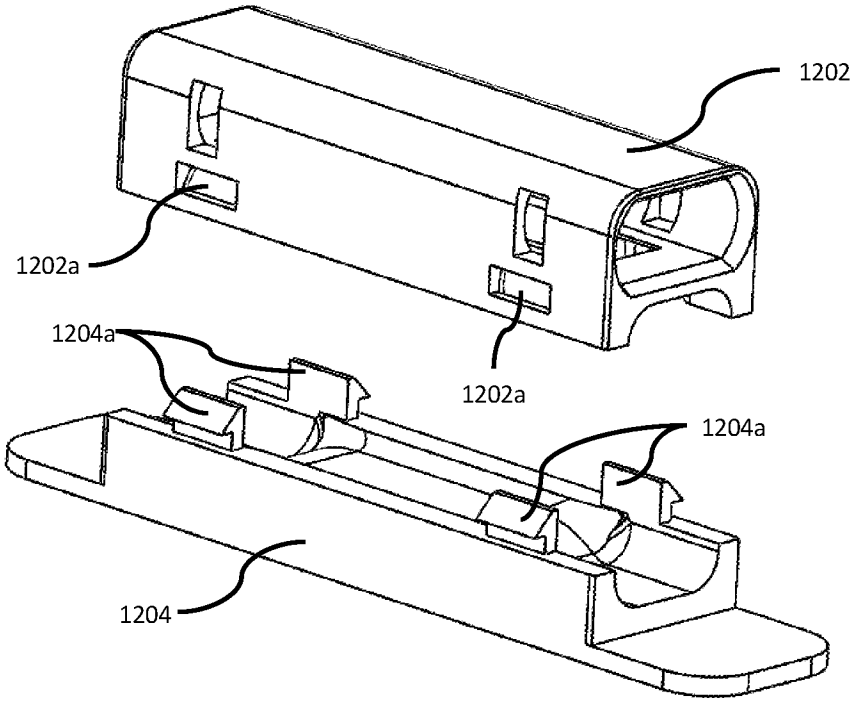
FIG. 13 is an exploded view depicting the components of the low profile priming well of FIG. 12, in accordance with certain examples.

FIGS. 12 and 13 depict an alternative construction of the priming well 110. FIG. 12 is a perspective view depicting a priming well 1200, in accordance with certain examples. FIG. 13 is an exploded view depicting the components of the priming well 1200 of FIG. 12, in accordance with certain examples.

The priming well 1200 comprises an upper housing 1202 and a lower housing 1204. Apertures 1202*a* of the upper housing 1202 receive tabs 1204*a* of the lower housing 1204 as the upper housing 1202 and the lower housing 1204 are mated together. The tabs 1204*a* engage the apertures 1202*a* to connect the upper housing 1202 and the lower housing 1204. The upper housing 1202 and the lower housing 1204 can be disconnected from each other by pushing the tabs 1204*a* into the apertures 1202*a* to release the engagement.

The priming well 1200 further comprises the features discussed previously with reference to FIGS. 8-11, except for the components that connect the two halves of the priming well housing.

Figure 26:
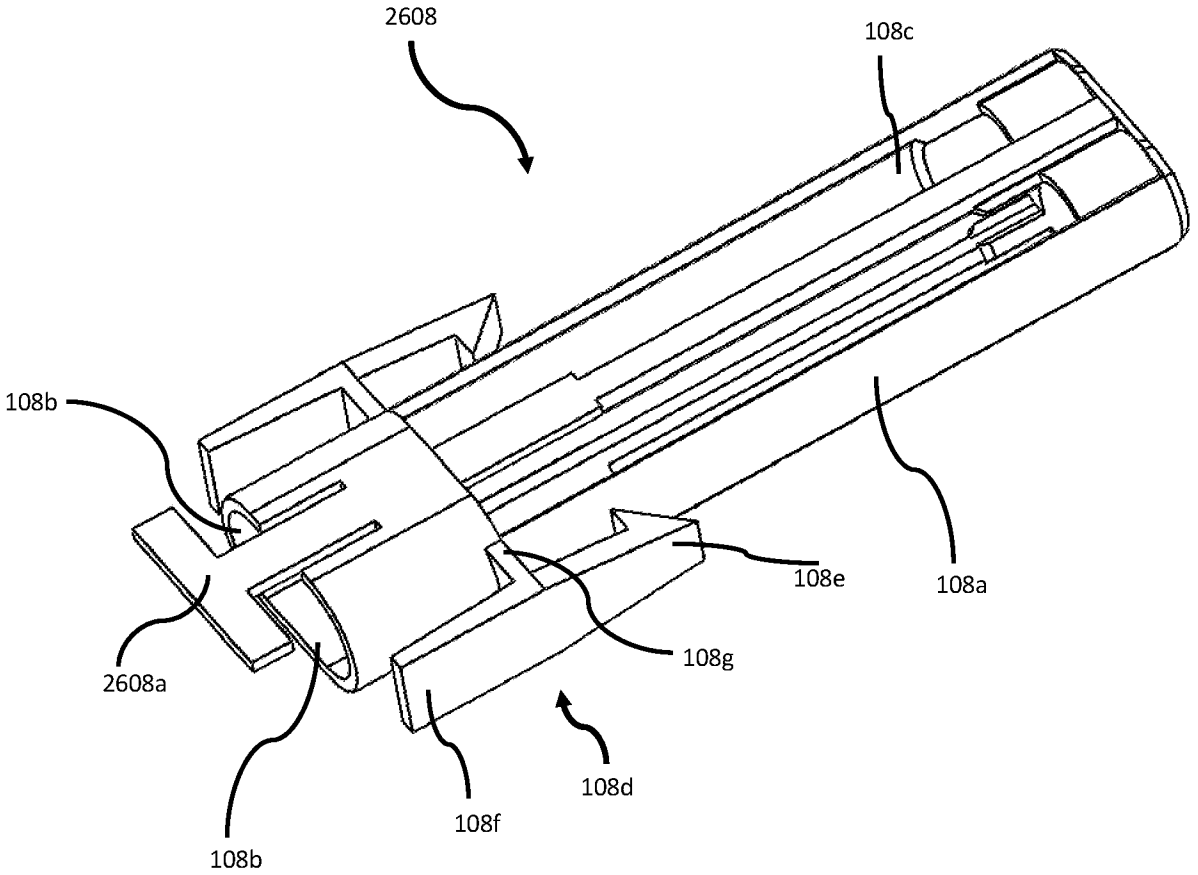
FIG. 26 is a perspective view of a cap box comprising a blasting cap retainer, in accordance with certain examples.
Figure 27:
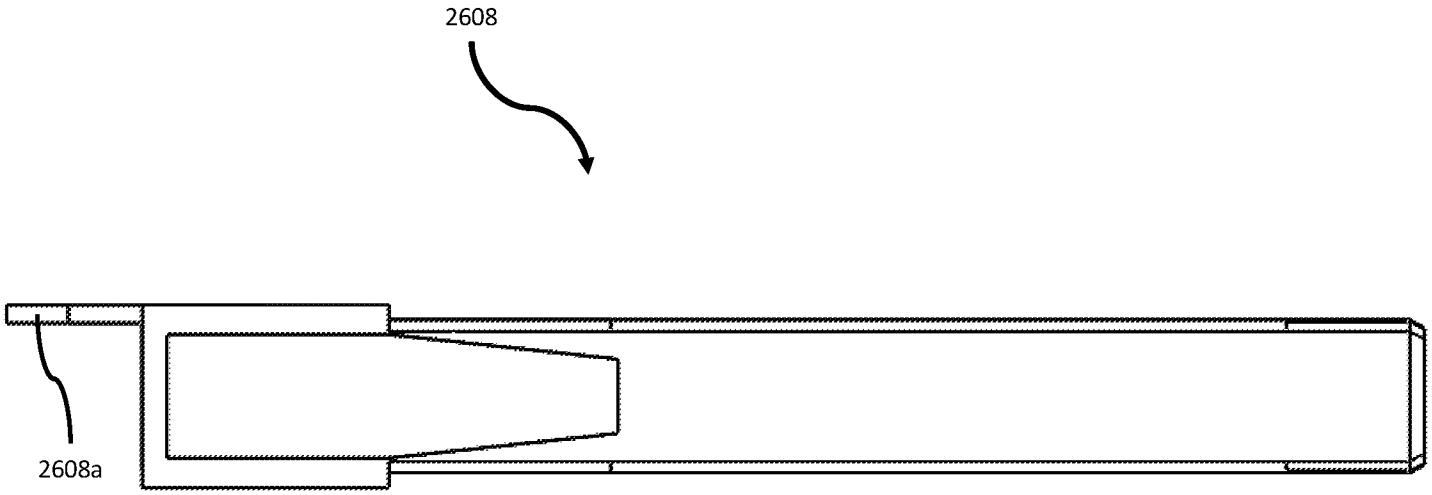
FIG. 27 is a side view of a cap box comprising a blasting cap retainer in an open position, in accordance with certain examples.
Figure 28:
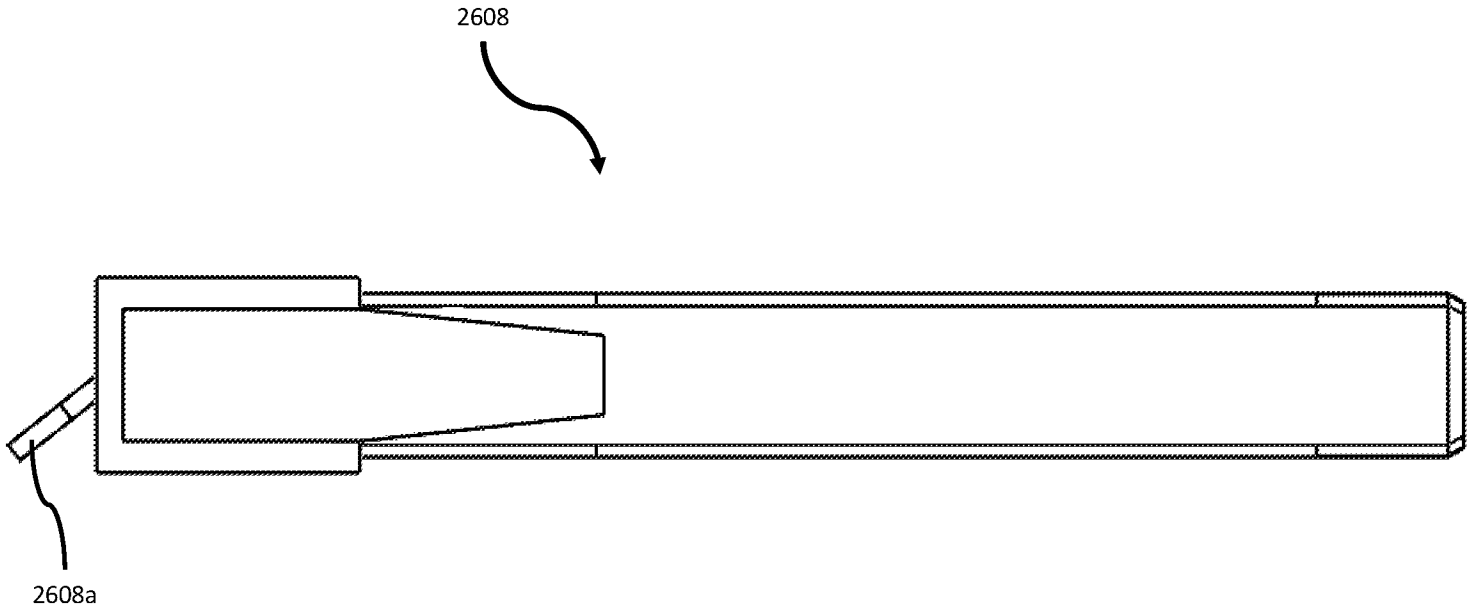
FIG. 28 is a side view of a cap box comprising a blasting cap retainer in a closed position, in accordance with certain examples.
Figure 29:
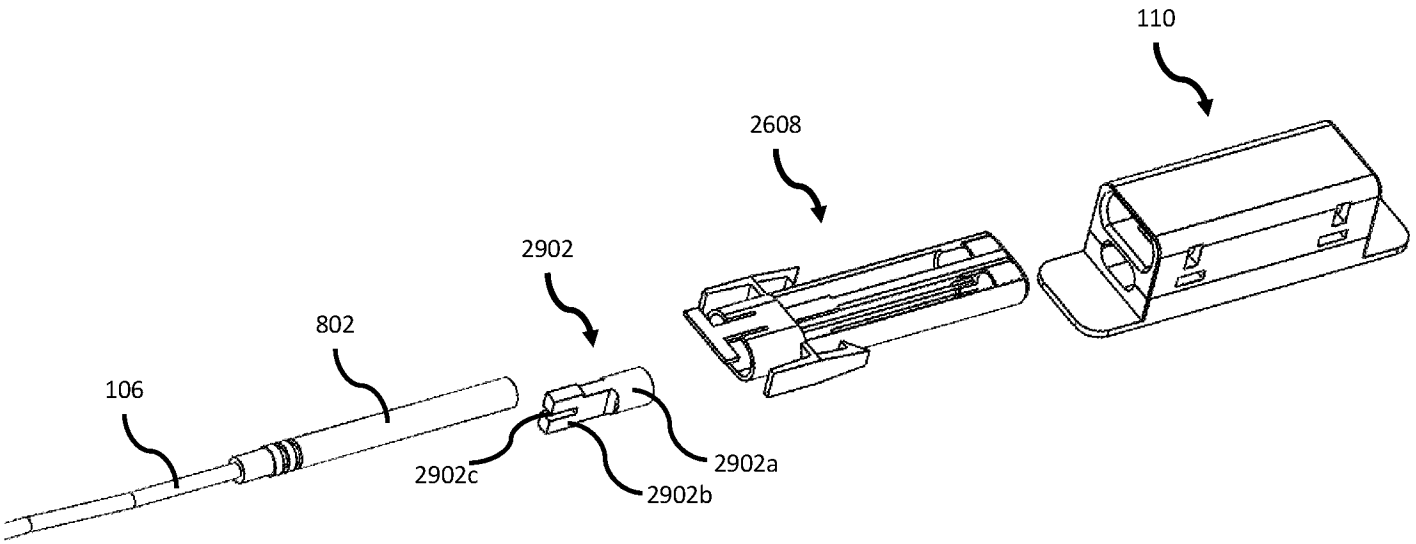
FIG. 29 is an assembly diagram depicting a blasting cap, single prime adapter plug, cap box comprising a blasting cap retainer (T-bar fitting), and a priming well in position for assembly, in accordance with certain examples.
Figure 30:
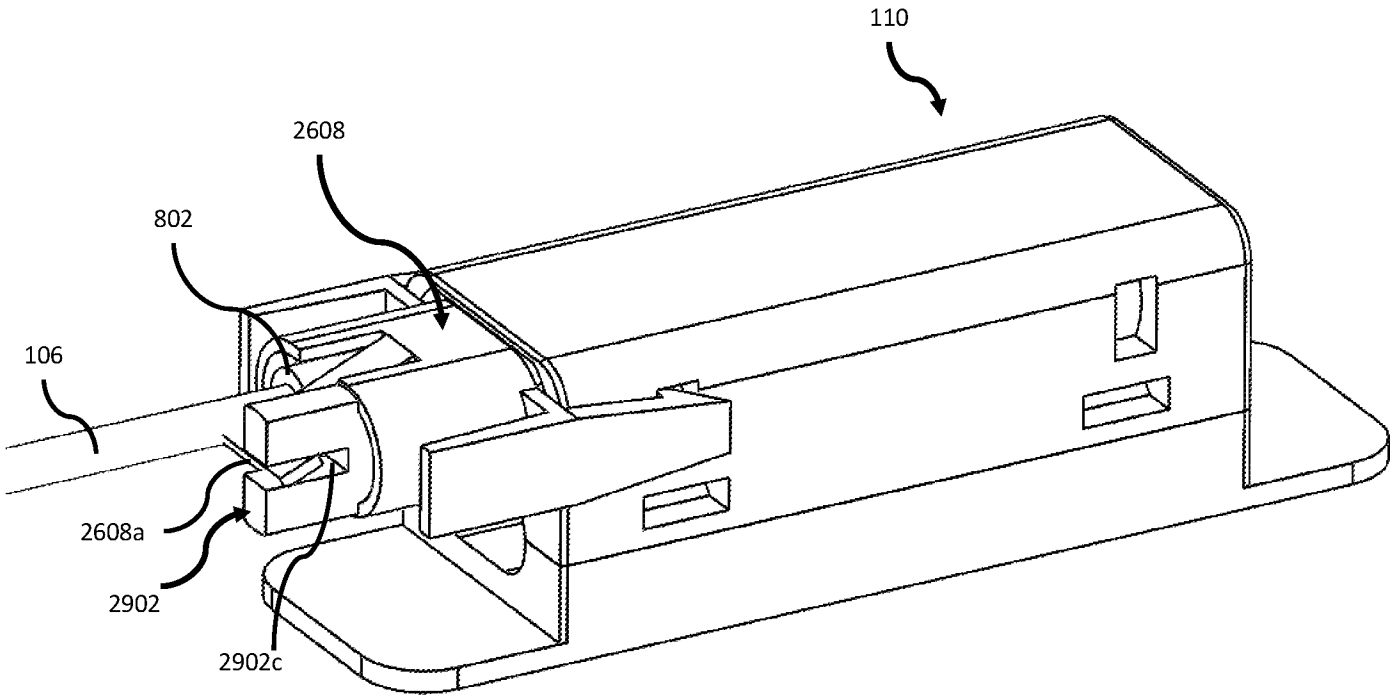
FIG. 30 is an assembly diagram depicting the blasting cap/cap box inserted into the priming well, in accordance with certain examples.

A cap box comprising a blasting cap retainer will now be described with reference to FIGS. 26-30. FIG. 26 is a perspective view of a cap box 2608 comprising a blasting cap retainer 2608*a*, in accordance with certain examples. FIG. 27 is a side view of a cap box 2608 comprising a blasting cap retainer 2608*a* in an open position, in accordance with certain examples. FIG. 28 is a side view of a cap box 2608 comprising a blasting cap retainer 2608*a* in a closed position, in accordance with certain examples. FIG. 29 is an assembly diagram depicting a blasting cap 802, cap box 2608 comprising a blasting cap retainer 2608*a*, single prime adapter plug 2902, and a priming well 110 in position for assembly, in accordance with certain examples. FIG. 30 is an assembly diagram depicting the blasting cap 802/cap box 2608 inserted into the priming well 110, in accordance with certain examples.

The cap box 2608 comprises substantially the same features as the cap box 108 described elsewhere herein. The cap box 2608 further comprises a cap box retainer 2608*a* moveable from an open position (see FIGS. 26-27 and 29) to a closed position (see FIGS. 28 and 30). When the cap box retainer 2608*a* is in the open position, a blasting cap 802 can be inserted into the cap box 2608. In the closed position, the cap box retainer 2608*a* helps hold the blasting cap 802 in the cap box 2608.

As depicted, the blasting cap retainer 2608*a* may comprise a T-shape. Each side of the T is positioned adjacent one of the apertures 108*b* in the cap box 2608. Accordingly, one side of the T helps retain a blasting cap in one aperture 108*b* of the cap box 2608, and another side of the T helps retain another blasting cap in the other aperture 108*b* of the cap box 2608.

Alternatively, the blasting cap retainer 2608*a* may comprise an L-shape. In this configuration, the blasting cap retainer 2608*a* helps hold a single blasting cap 802 in one aperture 108*b* of the cap box 2608.

In operation, the blasting cap retainer 2608*a* is moved to the open position, a blasting cap 802 is inserted into an aperture 108*b* of the cap box 2608, and the blasting cap retainer 2608*a* is moved over the shock tube 106 end of the blasting cap 802 to position one side of the T-shape around the shock tube 106 behind the blasting cap 802. The blasting cap retainer 2608*a* may be manipulated further (for example, by twisting) to move the single prime adapter/blasting cap retainer 2608 under the shock tube 106 to provide additional support to retain the blasting cap 802 in the cap box 2608. Alternatively, the blasting cap retainer 2608*a* is moved beyond the closed position, a blasting cap 802 is inserted into an aperture 108*b* of the cap box 2608 by positioning the shock tube lead to the blasting cap 802 over one side of the T-shape, and the blasting cap retainer 2608*a* is moved up to position the one side of the T-shape around the shock tube 106 and behind the blasting cap 802. In each case, the blasting cap retainer 2608*a* is positioned to assist holding the blasting cap 802 in the cap box 2608.

As depicted in FIGS. 29-30, a single prime adapter/cap box plug 2902 may be utilized when only one blasting cap 802 is inserted into the cap box 2608. The single prime adapter/cap box plug 2902 comprises a first end 2902*a* that is sized to correspond with a size of the opening 108*b* in the cap box 2608. The single prime adapter/cap box plug 2902 further comprises a handle end 2902*b* opposite the first end 2902*a*. An operator manipulates the handle end 2902*b* to insert the single prime adapter/cap box plug 2902 into the opening 108*b* in the cap box 2608. The single prime adapter/cap box plug 2902 also comprises a slot 2902*c* in the handle end 2902*b*. The slot 2902*c* receives one side of the T of the blasting cap retainer 2608*a*. In this manner, the single prime adapter/cap box plug 2902 holds the blasting cap retainer 2608*a* in position to hold the blasting cap 802 in the aperture 108*b* of the cap box 2608. The single prime adapter/cap box plug 2902 limits lateral movement of the blasting cap retainer 2608*a*, thereby further securing the blasting cap 802 in the aperture 108*b* of the cap box 2608. The single prime adapter/cap box plug 2902 depicted in FIGS. 29-30 comprises two tabs created by the slot 2902*c*. Alternatively, the single prime adapter/cap box plug 2902 may comprise a single tab, in which case the slot 2902*c* and the second tab are omitted.

In operation of the explosive detonating systems 100 described herein, the detonating cord 112 from the main explosive charge 114 is inserted into the priming well 110. In a typical configuration, the priming well 110 is attached to, or hanging from, the main charge.

The operator plugs the cap box 108 into the priming well 110. The operator plugs the shock tube adapter 104 into the firing actuator 102. The firing actuator 102 is unable to initiate the firing system until all of the components of the full system are connected to one another in the described manner and the hammers 304 are cocked.

The explosive detonating system 100 allows the operator to quickly connect/disconnect from the explosive system at two critical interfaces, at the shock tube adapter 104 and at the priming well 110. Only when the entire system is fully assembled (typically at the desired location for the explosion) is the system ready (or capable) for operation. This configuration allows for safer transport and storage of the system. In contrast, conventional systems are configured before transportation to a desired location because the components do not disassemble.

To initiate the system, the operator assembles the components as described above. The operator affixes the detonating cord 112 from the priming well 110 to the main explosive charge 114. The operator transports the firing actuator 102 away from the main explosive charge 114 to a distance controlled by the length of the shock tube 106. For example, the operator may use twenty feet of shock tube 106 to allow the operator to pull the trigger 302 of the firing actuator 102 twenty feet away from the main charge. Therefore, when the main charge explodes, the operator is in a safer location.

The description of the operation provided above encompasses any of the firing actuators, shock tube adapters, and/or cap boxes described herein.

The systems and components described herein may provide many advantages over conventional systems. For example, each shock tube adapter described herein may be utilized with a single firing actuator. More specifically, a single firing actuator may initiate any type of shock tube by utilizing the appropriate shock tube adapter for the corresponding shock tube and primer combination. The operator connects the firing actuator to a shock tube adaptor in a first system, and initiates a detonation in the first system. Then, the operator disconnects the shock tube adaptor from the first system, connects the firing actuator to a shock tube adapter in a second system, and initiates a detonation in the second system. The operator repeats this process in as many systems as desired. In this manner, the operator carries a single firing actuator to detonate multiple systems. Additionally, the single firing actuator works for any type of primer/shock tube by selecting the appropriate shock tube adapter. Although multiple shock tube adapters have been described herein, any shock tube adaptor can be configured for a particular shock tube and to engage with the firing actuator. In this manner, an operator can carry a single firing actuator to initiate detonation in an number of systems and for multiple different types of primers and shock tube. In contrast, conventional systems require a separate firing actuator for each detonation. For example, if an operator desires to initiate ten detonations, the operator must carry 10 conventional firing actuators (one firing actuator for each detonation). In this case of 10 detonations, the technology described herein can reduce the number and weight of firing actuators carried by the operator by 90%. Additionally, if the operator uses different types of shock tube, the operator must use a different conventional firing actuator specific to each different type of shock tube.

Although described herein as "shock tube" 106, any suitable stand-off device may be utilized. For example, the stand-off device can be electrical wire, shock-tube, time fuse, detonating cord, or other suitable stand-off device.

In alternate examples, the firing actuator can be actuated via a remote laser, or other remote signaling technology, such as radio frequency or infrared. For example, the firing actuator houses a laser or radio frequency (RF) system or a combination of both having an encoded signal. The shock tube adapter comprises a laser and/or RF receiver. This configuration allows the operator to remotely detonate the explosives from a safer distance from the explosives.

The remote device can have the same mechanical mechanism that the firing actuator described herein provides, including two striking mechanisms. However, instead of attaching the hand-held firing actuator and then being tethered to the charge, the remote device is activated with a coded signal on the hand-held device.

The charge is single or double primed, then the remote device is cocked. Then, a light illuminates to show the operator that the remote device is active. The operator connects the remote device to the shock tube adapter. The operator moves to a safe location and aims the hand-held device at the remote device and transmits the encoded signal from the hand-held device. The remote device may be configured to change to another color (red) and flash three times before activating the explosive charge.

The remote device provides multiple benefits. First, this device allows the operator to make adjustments that the shock tube may not be able to reach, thus, allowing the operator some flexibility in choosing a better cover position. Second, this device can have a time delay mode, so the operator can place the charge in one location and activate it, then move to another location and place another charge. When activated, the time delay prevents detonation for a configured amount of time or until the encoded signal is transmitted. This capability gives the operator much more flexibility.

Further, conventional systems limit the distance that an operator must be from the explosion based on the length of shock tube used in the charge. For example, if ten feet of shock tube is used between the shock tube adapter and the cap box, then the operator is only able to fire the system from approximately ten feet away. Additionally, shock tube can become tangled, which may limit or prevent its effective operation. In this alternative example, the operator may only require six inches of shock tube because the operator is able to trigger the system from any distance afforded by the effective range of the coded signal. Furthermore, if the signal is an RF signal, they can effectively initiate the device without being in the line of sight. Additionally, an RF signal would work through smoke, dust, fog, and/or heavy rain.

This encoded signal system securely allows a placed charge to be detonated from much greater distances than is practical with shock tube during breaching operations. It can also better facilitate coordinated or command controlled situations. The effect of larger distances between personnel and detonations reduces the physical effects of the blast on personnel and can allow better cover and concealment thereby increasing safety.

The Remote Firing Device System (RFDS) uses a hand-held Transmitter Device (TD) that, upon illuminating a target on a charge that is equipped with a like coded Receiver-Detonator, detonates the charge. To avoid certain jamming techniques employed against the system, in certain operations, the RFDS utilizes a specific frequency containing a transmitted code.

During operations, the Receiver-Detonator (R-D) is not armed until the charge is placed in the desired location. The operator turns the power button to "On," and a light will illuminate the receiver window. The operator cocks the R-D, and the light will change color or intensity. Only then will the operator connect the R-D to the charge. Once the charge has been placed and the remote detonator is armed, the operator can move away from the charge to a position of safety. From a safe position the operator can activate the R-D unit by aiming the encoded transmitting device at the R-D and transmit the encoded initiation signal. Once the R-D receives the code, it will activate a second count down to detonation.

The Remote Firing Device System consists of two assemblies: First, A Remote Firing Device (RFD) that emits the encoded detonating signal from a position of safety and concealment. The RFD contains the transmitter and driving electronics to send a preprogrammed secure firing code to the remote detonator. The firing device will look and act much like a small hand gun to allow the transmitter to be aimed. Second, A Receiver-Detonator (R-D) that ignites an electric spark, initiates an electronic trigger, or actuates an electronically secured spring actuator which engages a firing pin to strike a percussion cap and ignite a redundant or single shock tube. The shock tube is attached to a standard blasting cap. The shock tube can be of any length allowing the placement of the R-D in a position that can be viewed from position of cover and concealment for detonation.

Certain components of the systems described herein can be combined with portions of other systems and still achieve benefits of the described systems. For example, the priming well can be incorporated into a system using a conventional firing device or other firing device. In this case, the system may be connected and disconnected between a fire mode and a safe mode by connecting and disconnecting the blasting caps from the priming well and/or the detonating cord from the priming well. Additionally, the shock tube adapter can be incorporated into a system using a conventional method and components to connect the blasting caps to the detonating cord. In this case, the system may be connected and disconnected between a fire mode and a safe mode by connecting and disconnecting the shock tube adapter from the firing device and/or the shock tube case from the priming well case.

The components and systems described herein can be formed of any suitable material. A person having ordinary skill in the art and the benefit of this disclosure will understand that multiple options exist for manufacturing the components and systems described herein. For example, the components may be formed of plastic and injection molded, 3-D printed, or otherwise formed is integral or multi-component parts. The components also may be formed partially or entirely of other materials, such as metals. Individual components described herein may be formed of multiple parts formed from the same or different materials and assembled together.

The example systems, methods, and components described in the embodiments presented previously are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation so as to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. A system to detonate explosives, comprising:

a firing device comprising a firing pin; and a plurality of detachable shock tube adapters, each shock tube adapter comprising a housing configured to hold a primer and a shock tube while each shock tube adapter is detached from the firing device, the firing device and each shock tube adapter being configured to removably couple each shock tube adapter alternately to the firing device while each shock tube adapter is holding a primer and a shock tube such that the primer in each shock tube adapter coupled to the firing device is positioned to be contacted by the firing pin.

2. The system of claim 1, wherein at least one shock tube adapter is configured to accept a different shock tube and primer configuration than at least one other shock tube adapter.

3. The system of claim 2, wherein a first shock tube and primer configuration comprises a primer that is separate from a shock tube, wherein the housing of a shock tube adapter that is configured to accept the first shock tube configuration comprises a first aperture that receives the primer, a second aperture that receives the shock tube, and a passage within the adapter that creates a pathway from the received primer to the received shock tube.

4. The system of claim 3, the housing of the shock tube adapter that is configured to accept the first shock tube configuration further comprising a shock tube case and a primer case, the first aperture being disposed in the primer case, the second aperture being disposed in the shock tube case, and the shock tube case and the primer case comprising a retention mechanism that detachably couples the shock tube case to the primer case.

5. The system of claim 2, wherein a second shock tube and primer configuration comprises a primer that is coupled to shock tube via a primer housing prior to connecting the second shock tube and primer configuration to a shock tube adapter, wherein the housing of a shock tube adapter that is configured to accept the second shock tube and primer configuration comprises at least one tubular aperture sized to receive at least the primer housing having the primer therein and coupled to the shock tube.

6. The system of claim 2, wherein a third shock tube and primer configuration comprises a primed cartridge case that is separate from shock tube, wherein the housing of a shock tube adapter that is configured to accept the third shock tube configuration comprises a first aperture that receives the primed cartridge case, an inner tubular structure around which the primed cartridge case is disposed, a second aperture that receives shock tube, and a passage within the inner tubular structure that creates a pathway from the primed cartridge case to the shock tube.

7. The system of claim 1, further comprising:

a blasting cap connected to an end of shock tube that is opposite the particular shock tube adapter;

a detonating cord; and a priming well configured to receive the blasting cap and a section of the detonating cord such that insertion of the blasting cap into the priming well and insertion of the section of the detonating cord into the priming well places the inserted blasting cap in overlapping proximity to the inserted section of the detonating cord such that initiation of the blasting cap will initiate detonation of the detonating cord.

8. The system of claim 7, further comprising a cap box, wherein the blasting cap is inserted into the cap box, and wherein the cap box is inserted into the priming well to insert the blasting cap into the priming well.

9. The system of claim 8, the cap box comprising:

a cap box housing, the housing comprising:

an aperture configured to receive the blasting cap therein; and a retaining tab disposed at the aperture and movable between a first position that allows insertion of the blasting cap into the aperture and a second position that disposes at least a portion of the tab behind the inserted blasting cap to retain the blasting cap in the aperture of the housing.

10. The system of claim 9, the cap box housing further comprising at least one retaining mechanism configured to mate the cap box with the priming well when the cap box is inserted into the priming well.

11. The system of claim 9, the cap box housing comprising a second aperture configured to receive a second blasting cap therein, the cap box further comprising a plug inserted into the second aperture.

12. The system of claim 11, the plug comprising at least one tab configured to engage the retaining tab when the retaining tab is in the second position.

13. The system of claim 11, the plug comprising a slot configured to engage the retaining tab when the retaining tab is in the second position.

14. The system of claim 7, further comprising a main explosive connected to the detonating cord.

15. The system of claim 1, wherein each shock tube adapter and the firing device comprise corresponding retaining mechanisms that mate each shock tube adapter to the firing device when removably coupled to the firing device.

16. The system of claim 1, wherein the housing of one of the shock tube adapters comprises a tubular aperture sized to receive a primer housing having a primer therein and coupled to a shock tube.

17. The system of claim 16, wherein the tubular aperture is open along an edge of the housing to receive the primer housing via a snap fit.

18. The system of claim 16, wherein the tubular aperture is open along an edge of the housing to receive the shock tube, wherein movement of the received shock tube away from the housing engages the primer housing in the tubular aperture.

19. The system of claim 6, wherein the primed cartridge comprises a 9 mm, 25 ACP, or 38 special caliber shell.

20. The system of claim 1, the firing device further comprising an adapter retaining tab and a latch, wherein each shock tube adapter comprises a retaining indent configured to rotatably engage with the adapter retaining tab of the firing device, and wherein the firing device latch secures each shock tube adapter to the firing device when coupled to the firing device.

21. A method to detonate explosives, comprising:

assembling an explosive charge by coupling a percussion cap to a shock tube adapter, coupling a first end of a shock tube to the shock tube adapter, and coupling a second end of the shock tube to an explosive;

mating the shock tube adapter having the percussion cap and first end of the shock tube coupled thereto to a firing device; and initiating detonation of the explosive charge by firing the firing device to initiate the percussion cap, which initiates the shock tube coupled to the explosive.

* * * * *